US010589439B2

(12) United States Patent
McGuffin-Noll et al.

(10) Patent No.: US 10,589,439 B2
(45) Date of Patent: Mar. 17, 2020

(54) BLADE MOUNTING AND REMOVAL TOOL, SYSTEM, AND PRODUCT SLICER

(71) Applicant: GLOBE FOOD EQUIPMENT COMPANY, Dayton, OH (US)

(72) Inventors: Douglas J. McGuffin-Noll, Westerville, OH (US); Peter Dierauer, Jamestown, OH (US)

(73) Assignee: Globe Food Equipment Company, Dayton, OH (US)

( * ) Notice: Subject to any disclaimer, the term of this patent is extended or adjusted under 35 U.S.C. 154(b) by 443 days.

(21) Appl. No.: 15/187,851

(22) Filed: Jun. 21, 2016

(65) Prior Publication Data

US 2017/0361428 A1 Dec. 21, 2017

(51) Int. Cl.

| | |
|---|---|
| ***B24B 45/00*** | (2006.01) |
| ***B27B 5/32*** | (2006.01) |
| ***B26D 7/26*** | (2006.01) |

(52) U.S. Cl.

CPC ..... *B26D 7/2621* (2013.01); *B24B 45/006* (2013.01); *B26D 2210/02* (2013.01); *B27B 5/32* (2013.01); *Y10T 403/7007* (2015.01)

(58) Field of Classification Search

CPC .... B25B 9/02; B26D 7/2621; B26D 2210/02; B26D 1/14; B26D 7/262; B26D 1/00; B26D 2001/0046; B26D 7/00; B23B 31/107; B23B 51/10; Y10T 279/17717; Y10T 279/17761; Y10T 279/17803; Y10T 279/32; Y10T 493/7007; B24B 45/006; B27B 5/30; B27B 5/32

USPC ..... 403/116, 349; 279/81, 71, 74, 140, 82; 451/359; 83/666

See application file for complete search history.

(56) References Cited

U.S. PATENT DOCUMENTS

| | | | |
|---|---|---|---|
| 1,795,931 | A | 3/1931 | Campbell |
| 2,001,771 | A | 5/1935 | Campbell |
| 2,433,600 | A | 12/1947 | Cohen |
| 2,598,740 | A | 6/1952 | Zimmerman |
| 2,682,289 | A | 6/1954 | Brown |

(Continued)

FOREIGN PATENT DOCUMENTS

| | | | |
|---|---|---|---|
| EP | 2 929 992 | A1 | 10/2015 |
| WO | 2007/103899 | A2 | 9/2007 |
| WO | 2012/175405 | A1 | 12/2012 |

OTHER PUBLICATIONS

International Search Report and Written Opinion of the International Searching Authority for International Application No. PCT/US17/16350, dated Apr. 12, 2017, eight pages.

(Continued)

*Primary Examiner* — Monica S Carter
*Assistant Examiner* — Mahdi H Nejad
(74) *Attorney, Agent, or Firm* — Brinks Gilson & Lione

(57) ABSTRACT

A blade mounting and removal tool, and system, for safely removing a blade from a blade axle of a food product slicer. The blade axle includes a multi-axis locking system for securing the blade to the blade axle. The blade removal tool includes a tool base, a blade engagement assembly, and a blade unlocking assembly. The blade engagement assembly is attached to the tool base and has a blade engagement actuator cooperating with at least one blade engagement retainer. The blade unlocking assembly is also attached to the tool base and has a blade unlocking actuator cooperating with a blade unlocking post.

24 Claims, 28 Drawing Sheets

(56) References Cited

U.S. PATENT DOCUMENTS 2,691,398 A 10/1954 Klingens
4,070,941 A 1/1978 Lorenz
4,345,498 A 8/1982 Best
4,546,685 A 10/1985 Maurer et al.
5,025,693 A 6/1991 Tidland et al.
5,224,407 A 7/1993 Koch et al.
5,509,337 A 4/1996 Norman et al.
5,584,084 A * 12/1996 Klearman ..... A61G 7/05769 403/2
5,666,866 A 9/1997 Huang et al.
5,687,626 A 11/1997 Scherch et al.
D390,414 S 2/1998 Shirk et al.
D390,748 S 2/1998 Short et al.
D404,611 S 1/1999 Heckman
5,862,730 A 1/1999 Cartwright et al.
5,970,840 A 10/1999 Yan et al.
6,003,724 A * 12/1999 Collins ..... A47F 1/065 221/154
6,030,326 A * 2/2000 Azuma ..... B27B 5/30 483/30
D422,449 S 4/2000 Johnson et al.
6,092,448 A 7/2000 Cartwright et al.
6,119,566 A 9/2000 Yan et al.
6,167,791 B1 1/2001 Heckman et al.
6,209,438 B1 4/2001 Mitchell et al.
6,261,161 B1 7/2001 Yan
6,282,794 B1 9/2001 Cho et al.
6,389,943 B1 5/2002 Wagner et al.
D463,713 S 10/2002 Zhu
6,709,319 B2 3/2004 Yan
6,845,697 B2 1/2005 Kovacs
6,935,216 B1 8/2005 Yan et al.
6,998,557 B2 2/2006 McGuffin-Noll
7,073,421 B1 7/2006 Verhalen et al.
7,134,937 B1 11/2006 Chen et al.
7,194,933 B2 3/2007 Zhu et al.
7,234,382 B2 6/2007 Zhu
7,257,899 B2 8/2007 Zhu et al.
8,136,435 B2 3/2012 Zhu et al.
8,181,973 B2 * 5/2012 Dezheng ..... B23D 51/10 279/71
9,050,733 B2 * 6/2015 Zhu ..... B26D 7/225
10,071,496 B2 * 9/2018 Weber ..... B26D 7/2621
2001/0039863 A1 * 11/2001 Adachi ..... B25B 13/48 83/13
2002/0017026 A1 * 2/2002 Kakiuchi ..... B23D 51/10 30/392
2003/0079589 A1 5/2003 Kovacs
2003/0079595 A1 5/2003 Shariff et al.
2003/0231927 A1 * 12/2003 Hale ..... B08B 9/045 403/349
2004/0000060 A1 1/2004 Zhu et al.
2005/0000346 A1 1/2005 Hartley et al.
2005/0011329 A1 1/2005 Briggs
2005/0045455 A1 3/2005 McGuffin-Noll
2005/0132854 A1 6/2005 Kovacs
2005/0156390 A1 * 7/2005 Marini ..... B23D 51/10 279/74
2005/0211045 A1 9/2005 Zhu et al.
2005/0276658 A1 * 12/2005 Silva ..... F16G 15/06 403/154
2006/0150791 A1 7/2006 Chase et al.
2006/0172668 A1 * 8/2006 Hofmann ..... B24B 23/02 451/359
2006/0219078 A1 10/2006 Parrish et al.
2007/0131076 A1 * 6/2007 Yasheng ..... B23D 51/10 83/699.21
2007/0137438 A1 6/2007 Zhu et al.
2007/0142959 A1 6/2007 Rummel et al.
2008/0196255 A1 8/2008 Strader
2008/0271584 A1 * 11/2008 Repaci ..... B26D 7/01 83/471
2009/0013845 A1 1/2009 Zhu et al.
2009/0133552 A1 5/2009 McGuffin-Noll
2010/0215428 A1 * 8/2010 Trice ..... B25G 1/04 403/359.5
2011/0314992 A1 12/2011 Ishihara
2013/0035221 A1 * 2/2013 Weber ..... B26D 1/157 483/1
2013/0087033 A1 4/2013 Tetreault et al.
2015/0290828 A1 * 10/2015 Weber ..... B26D 7/2621 83/663
2017/0232629 A1 * 8/2017 McGuffin-Noll ..... B26D 7/01 83/730

OTHER PUBLICATIONS

Supplementary European Search Report for EP 17 81 5835, dated Dec. 10, 2019, 8 pp.

* cited by examiner

BLADE MOUNTING AND REMOVAL TOOL, SYSTEM, AND PRODUCT SLICER

CROSS-REFERENCE TO RELATED APPLICATIONS

Not applicable.

STATEMENT REGARDING FEDERALLY SPONSORED RESEARCH OR DEVELOPMENT

This invention was not made as part of a federally sponsored research or development project.

TECHNICAL FIELD

The present disclosure relates generally to food product slicers, more particularly, to a system and components that promote safe removal, and installation, of a blade on a food product slicer, and the associated food product slicer.

BACKGROUND OF THE INVENTION

The removal, and re-installation, of a blade from a food product slicer is a very dangerous process. The industry has long needed a method that ensures the safe removal of a blade, particularly one that encourages safe positioning of the user during removal and requires the use of both of their hands in safe positions well away from the cutting edge.

SUMMARY OF THE INVENTION

A safety blade mounting and removal system for removing a blade from a blade axlese cured to a product slicer including a blade removal tool having a tool base, a blade engagement assembly, and a blade unlocking assembly. The blade engagement assembly is attached to the tool base and has a blade engagement actuator, or handle, cooperating with at least one blade engagement retainer, wherein relative movement of the blade engagement actuator, with respect to the tool base, from a blade engagement actuator initial position to a blade engagement actuator retaining position produces movement of the at least one blade engagement retainer from a retainer initial position to a retainer retaining position whereby at least a portion of the blade engagement retainer has engaged a portion of the blade to interlock the tool base and the blade. The blade unlocking assembly is attached to the tool base and has a blade unlocking actuator, or handle, cooperating with a blade unlocking post, wherein relative movement of the blade unlocking actuator with respect to the tool base from a blade unlocking actuator initial position to a blade unlocking actuator release position produces rotation of the blade unlocking post from a post initial position to a post release position, which rotates the blade axle or the blade to release the blade from the blade axle.

BRIEF DESCRIPTION OF THE DRAWINGS

Without limiting the scope of the present invention as claimed below and referring now to the drawings and figures:

Figure 1:
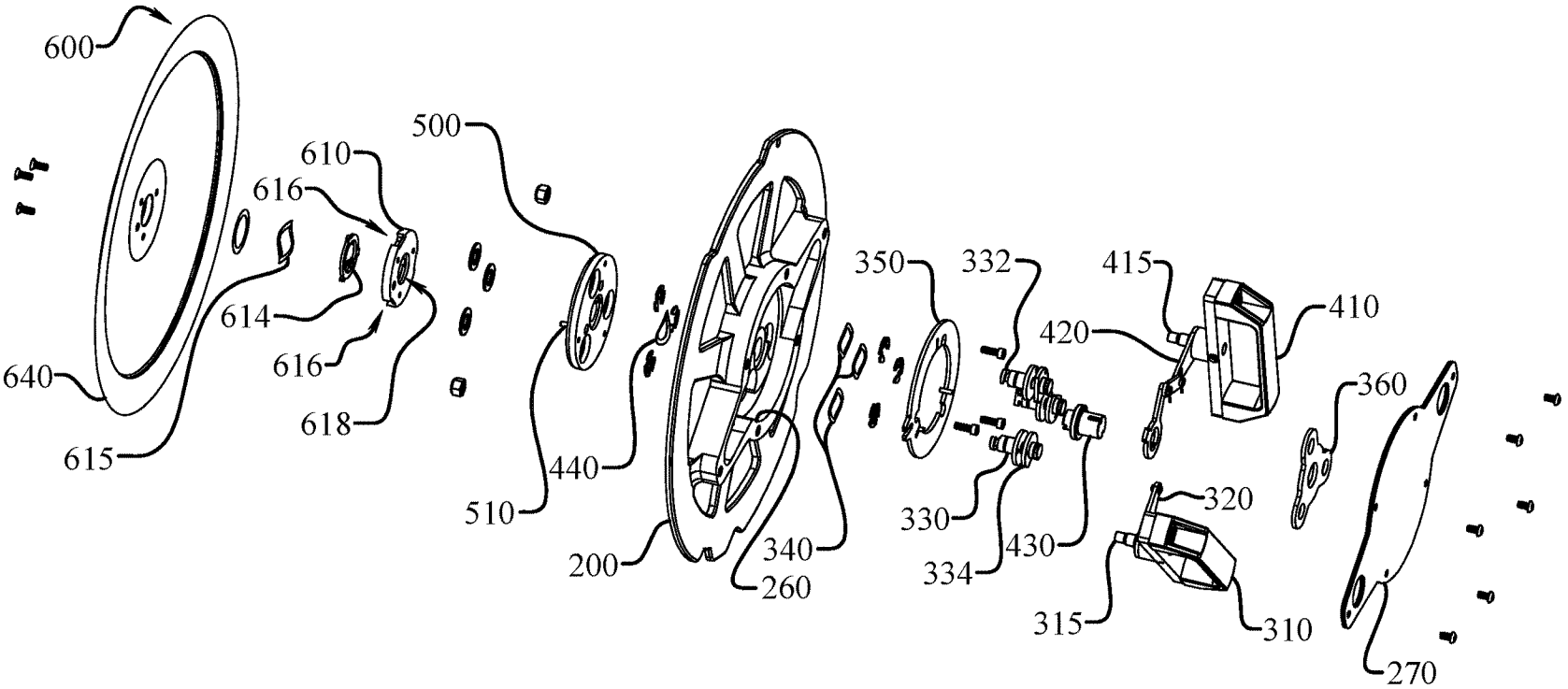
FIG. 1 shows an isometric assembly view of components of an embodiment of the safety blade mounting and removal system.

These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION OF THE INVENTION

The present invention enables a significant advance in the state of the art. The preferred embodiments of the invention accomplish this by new and novel arrangements of elements, materials, relationships, and methods that are configured in unique and novel ways and which demonstrate previously unavailable but preferred and desirable capabilities. The description set forth below in connection with the drawings is intended merely as a description of the presently preferred embodiments of the invention, and is not intended to represent the only form in which the present invention may be constructed or utilized. The description sets forth the designs, materials, functions, means, and methods of implementing the invention in connection with the illustrated embodiments. It is to be understood, however, that the same or equivalent functions, features, and material properties may be accomplished by different embodiments that are also intended to be encompassed within the spirit and scope of the invention. The present disclosure is described with reference to the accompanying drawings with preferred embodiments illustrated and described. The disclosure may, however, be embodied in many different forms and should not be construed as limited to the embodiments set forth herein; rather, these embodiments are provided so that this disclosure will be thorough and complete, and will fully convey the scope of the disclosure to those skilled in the art. Like numbers refer to like elements throughout the disclosure and the drawings. In the figures, the thickness of certain lines, layers, components, elements or features may be exaggerated for clarity. The inventive features include all novel and non-obvious features disclosed herein both alone and in novel and non-obvious combinations with other elements. As used herein, the phrase "and/or" means "and", "or" and both "and" and "or". As used herein, the singular forms "a," "an," and "the" refer to one or more than one, unless the context clearly dictates otherwise. As used herein, the term "includes" means "comprises." The preferred embodiments of the invention accomplish the stated objectives by new and novel arrangements of elements and configurations, materials, and methods that are configured in unique and novel ways and which demonstrate previously unavailable but preferred and desirable capabilities.

Figure 12A:
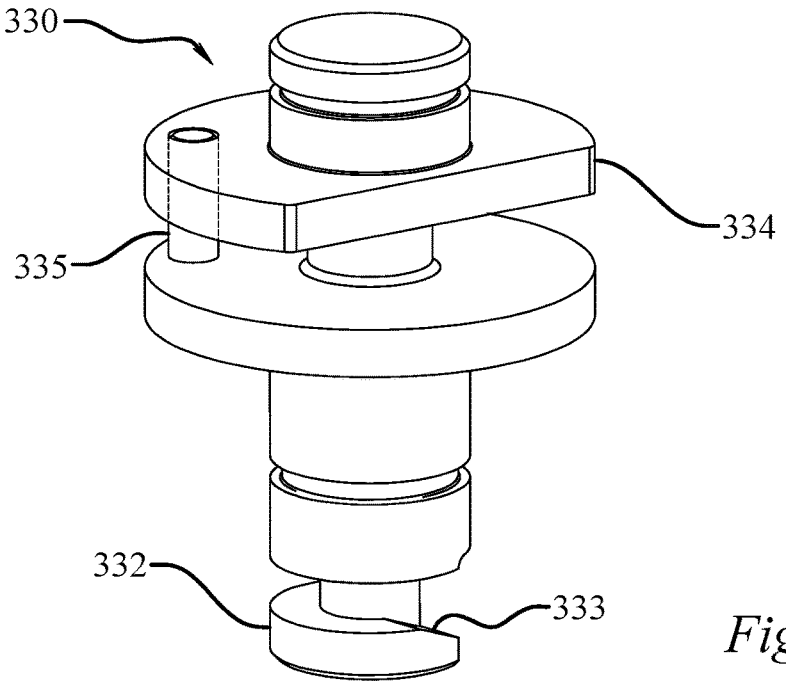
FIG. 12*a* shows a perspective view of an embodiment of a blade engagement retainer.
Figure 15:
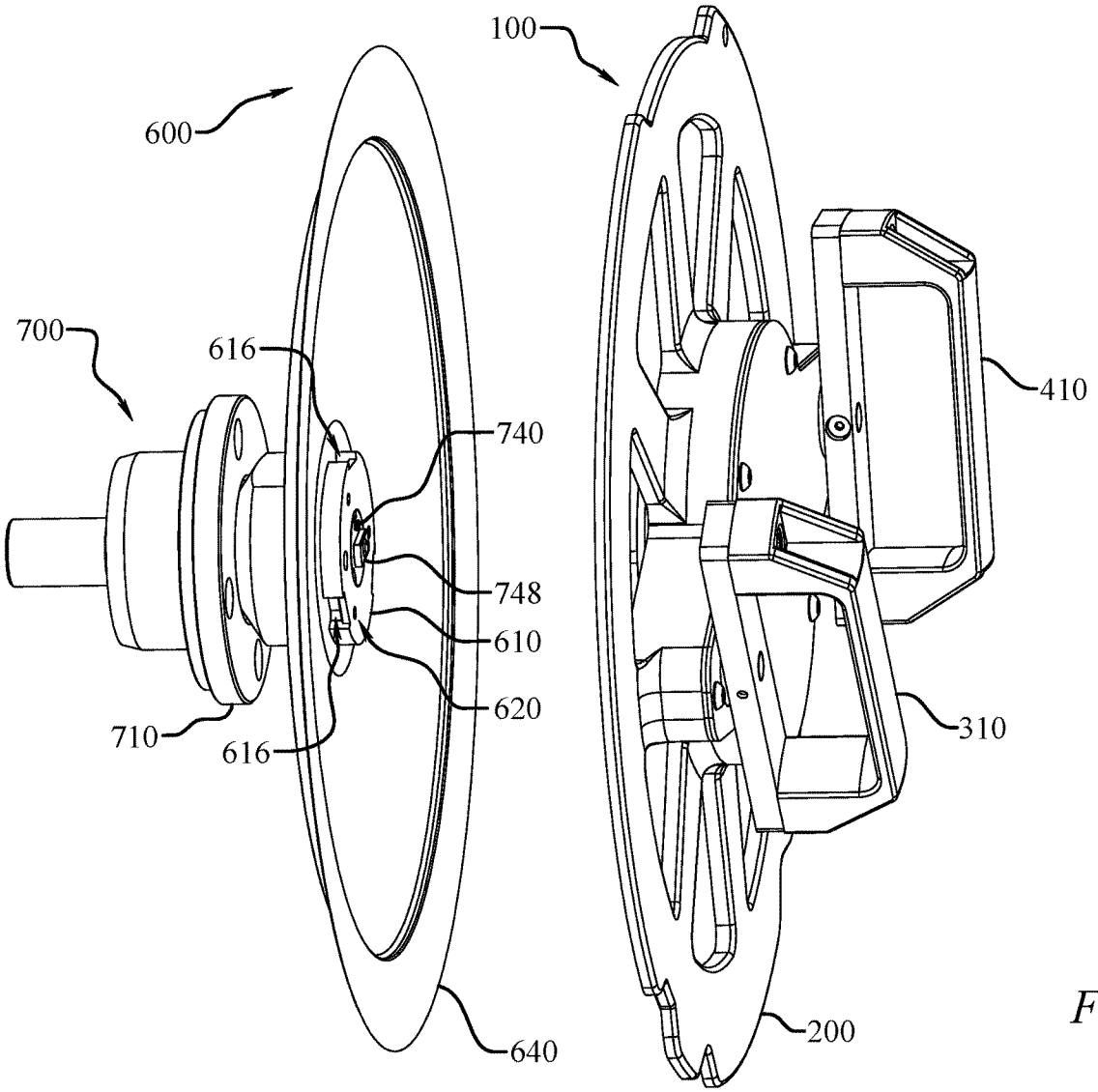
FIG. 15 shows a perspective assembly view of an embodiment of a blade axle, blade, and blade removal tool.
Figure 16:
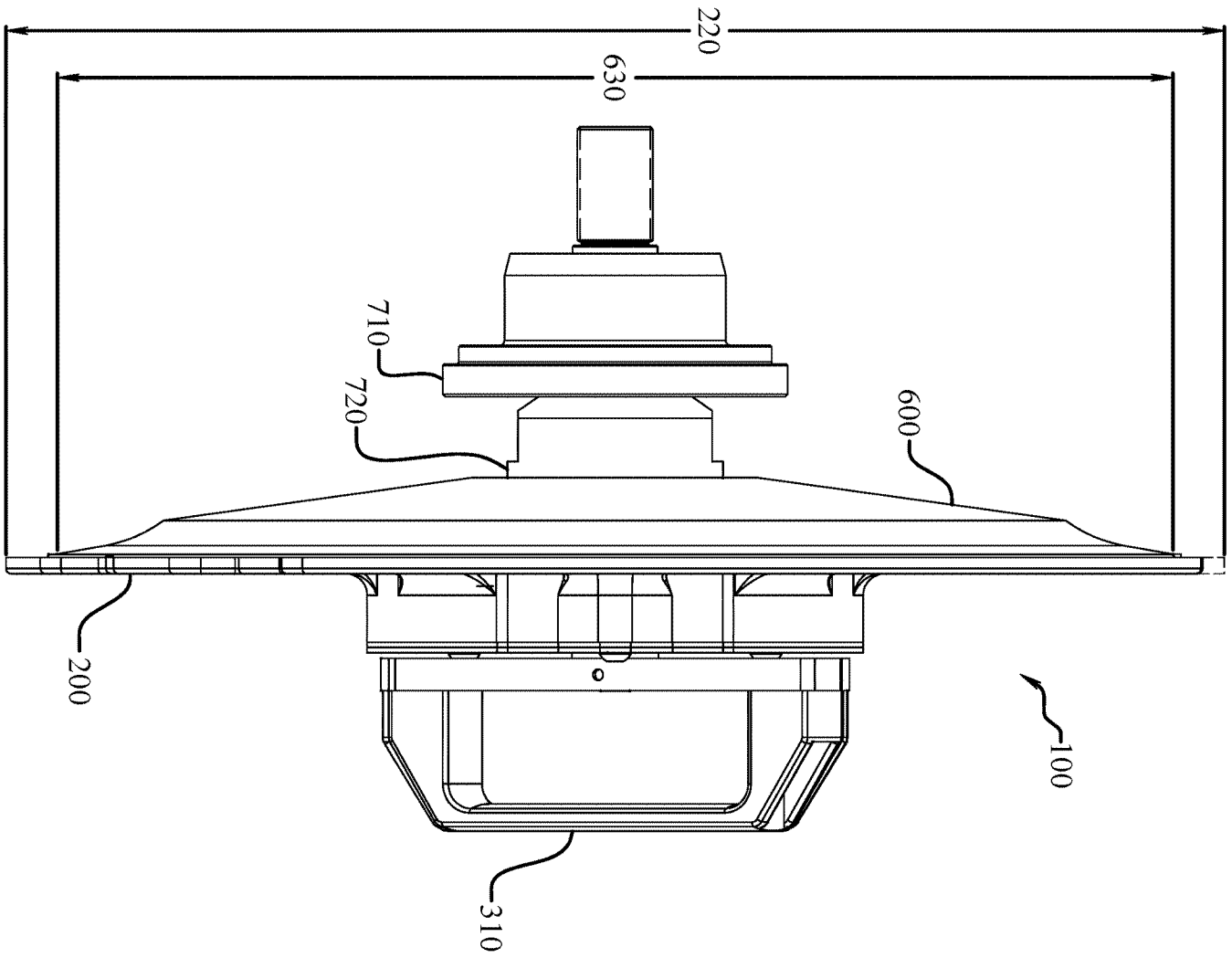
FIG. 16 shows a side elevation view of an embodiment of a blade axle, blade, and blade removal tool.
Figure 17:
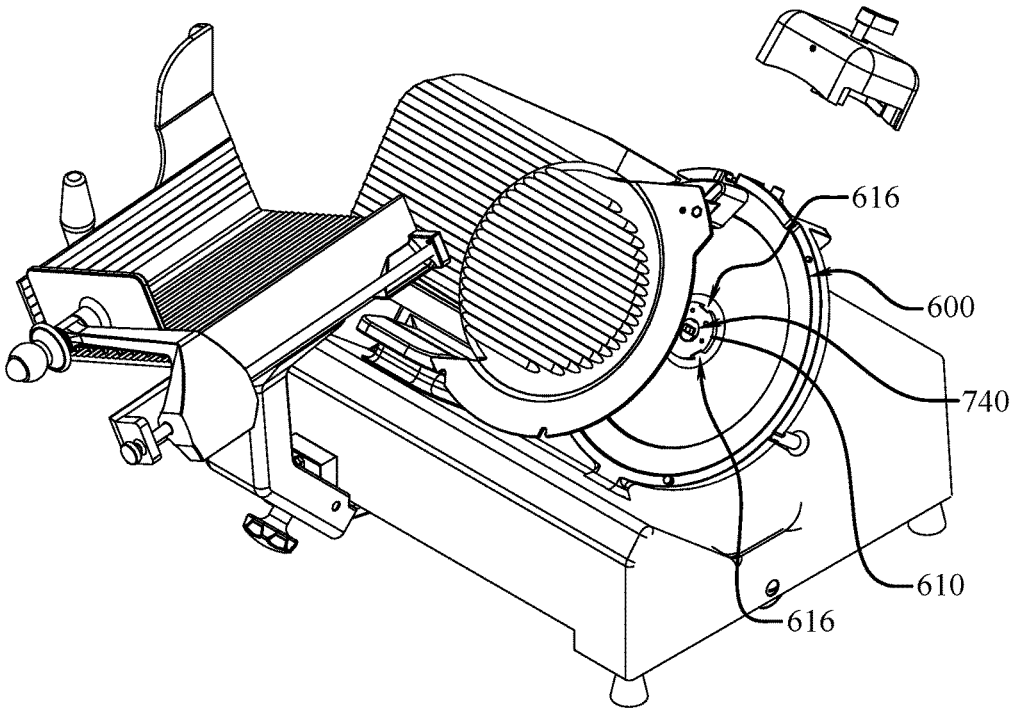
FIG. 17 shows a perspective view of an embodiment of a slicer with a partially removed blade guard and sharpener to reveal the blade, hub, and a portion of the blade axle.

In one series of embodiments the invention includes a safety blade mounting and removal system for safely removing a blade (600) from a product slicer, as seen in FIGS. 17-28. As illustrated in FIGS. 12*c*, 15, and 16, the system may include the blade (600), a blade axle (700) having a multi-axis locking system for securing the blade (600) to the blade axle (700), and a blade removal tool (100), aspects of which work together so that a user may safely install, and remove, the blade (600) on the blade axle (700) using the blade removal tool (100) without ever having physically contact the blade (600). In fact, as will be explained later in great detail, the blade removal tool (100) is designed to encourage, and in some embodiments requires, the user to keep their hands in safe positions while using the blade removal tool (100) thereby reducing the risk of unintentional contact with the blade (600), or a blade edge (640). Further, in some embodiments the blade removal tool (100) is designed to ensure the blade (600) is either secured to the blade axle (700) or the blade removal tool (100).

First, a general overview of some of the components in an embodiment of the system is in order. As seen best in FIGS. 1 and 12*b*, the blade (600) may include a hub (610), a hub aperture (618), and at least one hub engagement protrusion (614) extending into the hub aperture (618). It is important to note that the hub (610) and associated components need not necessarily be separate pieces attached to the blade (600), but rather may be formed in the blade (600). Thus, the term hub (610) is referring simply to an area of the blade (600), unless noted otherwise. The illustrations show a hub (610) that is a separate component attached to the blade (600), but one skilled in the art will appreciate that this is merely for general clarity and convenience unless noted otherwise, while in some embodiments the hub (610) is indeed a separate component attached to the blade (600) and offers simplified manufacturability, as well as being needed in some of the disclosed embodiments. The particular embodiment of FIG. 12*b* will be discussed in greater detail later with respect to an embodiment in which the at least one hub engagement protrusion (614) is biased, which is why it is illustrated as at least one finger extending from a ring that is received in a recess of the hub (610) and sandwiched between the blade (600) and the hub (610), with a protrusion biasing member (615) illustrated as a spring in FIG. 1.

Next, a general overview of an embodiment of the blade axle (700) is in order. As seen in FIGS. 15-18, the blade axle (700) is the interface between the slicer and the blade (600). The blade axle (700) is configured to securely, and releaseably, mount the blade (600) so that rotational motion may be transmitted from the slicer, through the blade axle (700), to result in rotation of the blade (600). Generally the blade axle (700) has a multi-axis locking system for securing the blade (600) to the blade axle (700). The term multi-axis locking system refers simply to the fact that when the blade (600) is installed on the blade axle (700) is must be moved in more than one axis to arrive at a blade operating position, whereby it is secure and may safely transmit rotation to the blade (600). With reference now to FIGS. 12*c* and 13, in one embodiment the multi-axis locking system includes a biased blade locking assembly (730) and a blade mount (740). The blade mount (740) cooperates with the blade (600), specifically the hub (610) and/or elements thereof, to receive the blade (600) onto the blade mount (740). As seen best in the enlarged view of FIG. 13, in one embodiment the blade mount (740) includes at least one mount channel (742) with an axial aspect (743) and a rotational aspect (745), thereby ensuring movement of the blade (600) in more than one axis to arrive at the blade operating position on the blade axle (700), hence the prior reference to multi-axis locking system. In these illustrated embodiments the biased blade locking assembly (730) is shown as a pin, or more appropriately as a blade axle locking pin (732) in the enlarged view of FIG. 13, extending from a blade axle blade support base (720), however one skilled in the art will appreciate that the biased blade locking assembly (730) is not limited to a pin-like configuration but rather may include equivalents, shapes, and configurations that perform the functions described herein. In one embodiment at least a portion of the blade axle locking pin (732) is recessed within the blade axle blade support base (720), which houses a locking pin bias spring (734) and a locking pin retainer (736), as seen in FIG. 14.

Figure 12B:
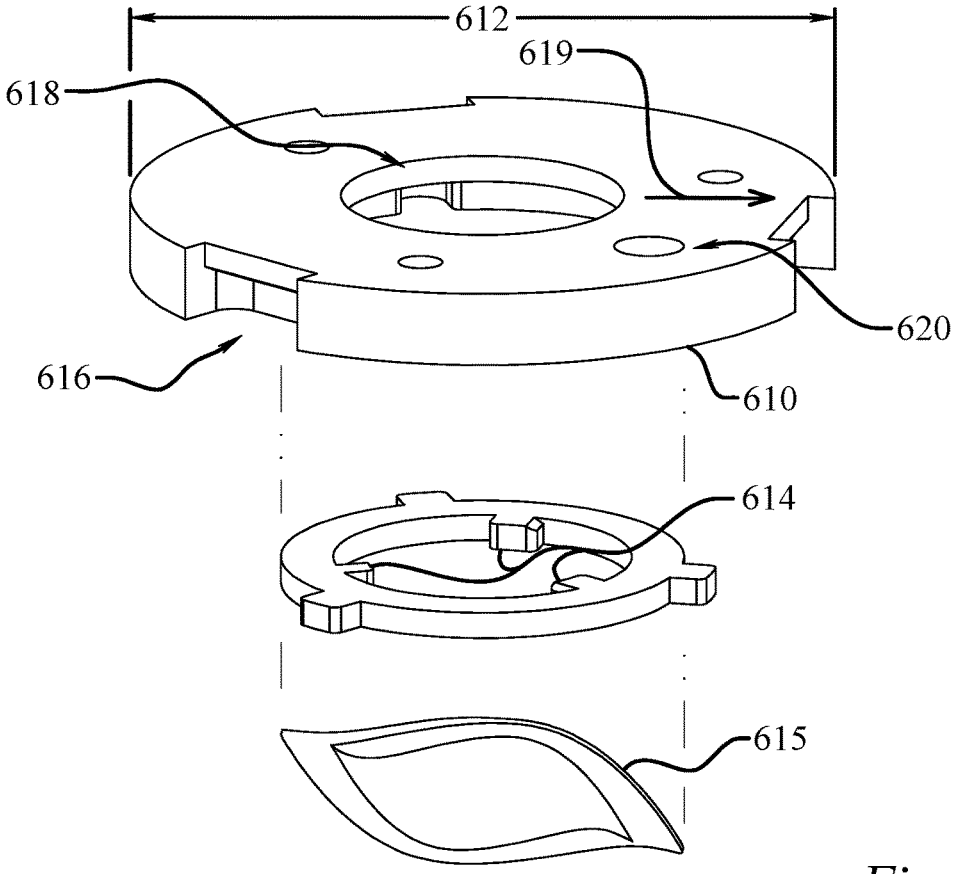
FIG. 12*b* shows a perspective view of components of an embodiment of a hub.
Figure 12C:
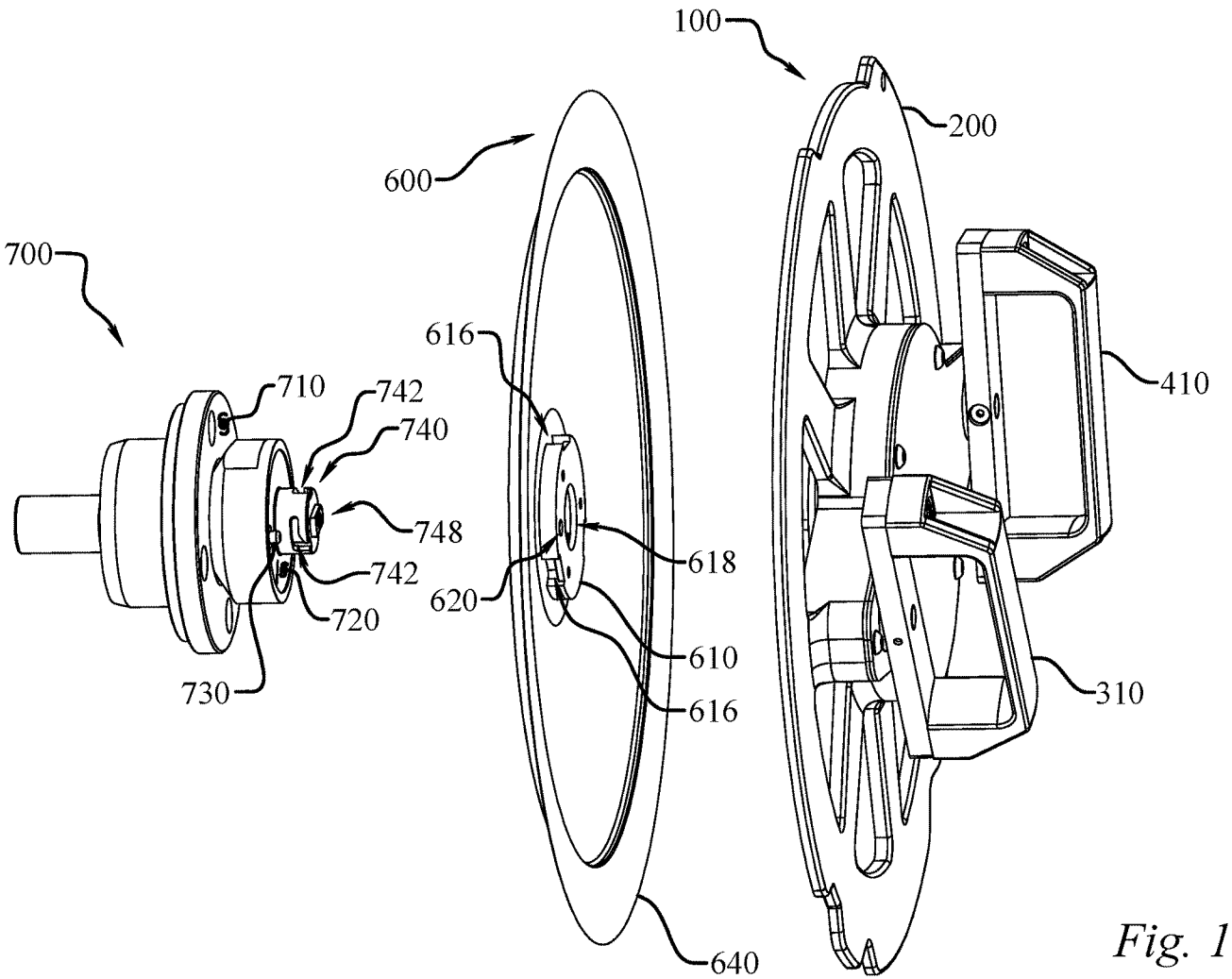
FIG. 12*c* shows a perspective assembly view of an embodiment of a blade axle, blade, and blade removal tool.
Figure 13:
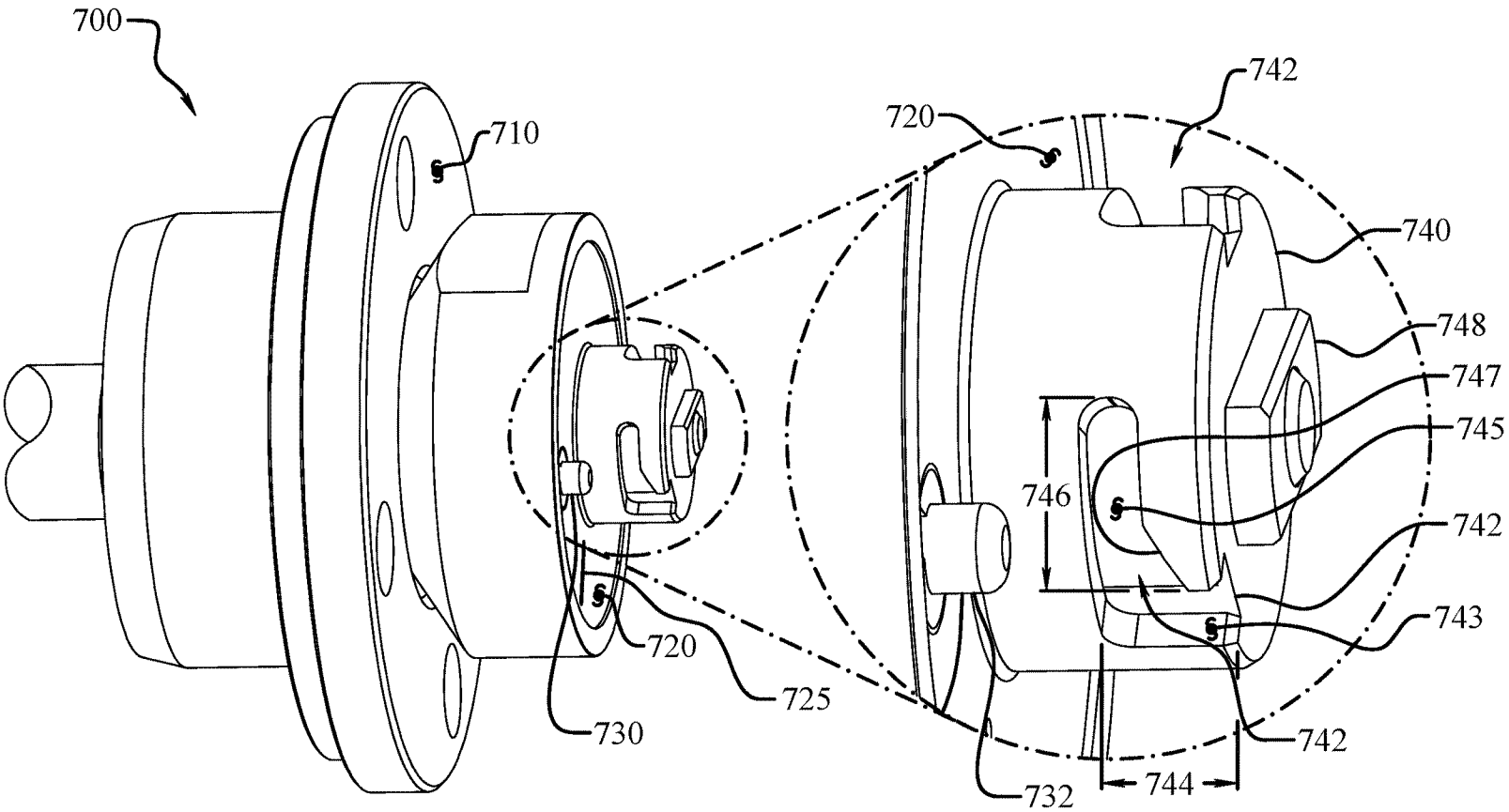
FIG. 13 shows a perspective view of an embodiment of a blade axle.
Figure 14:
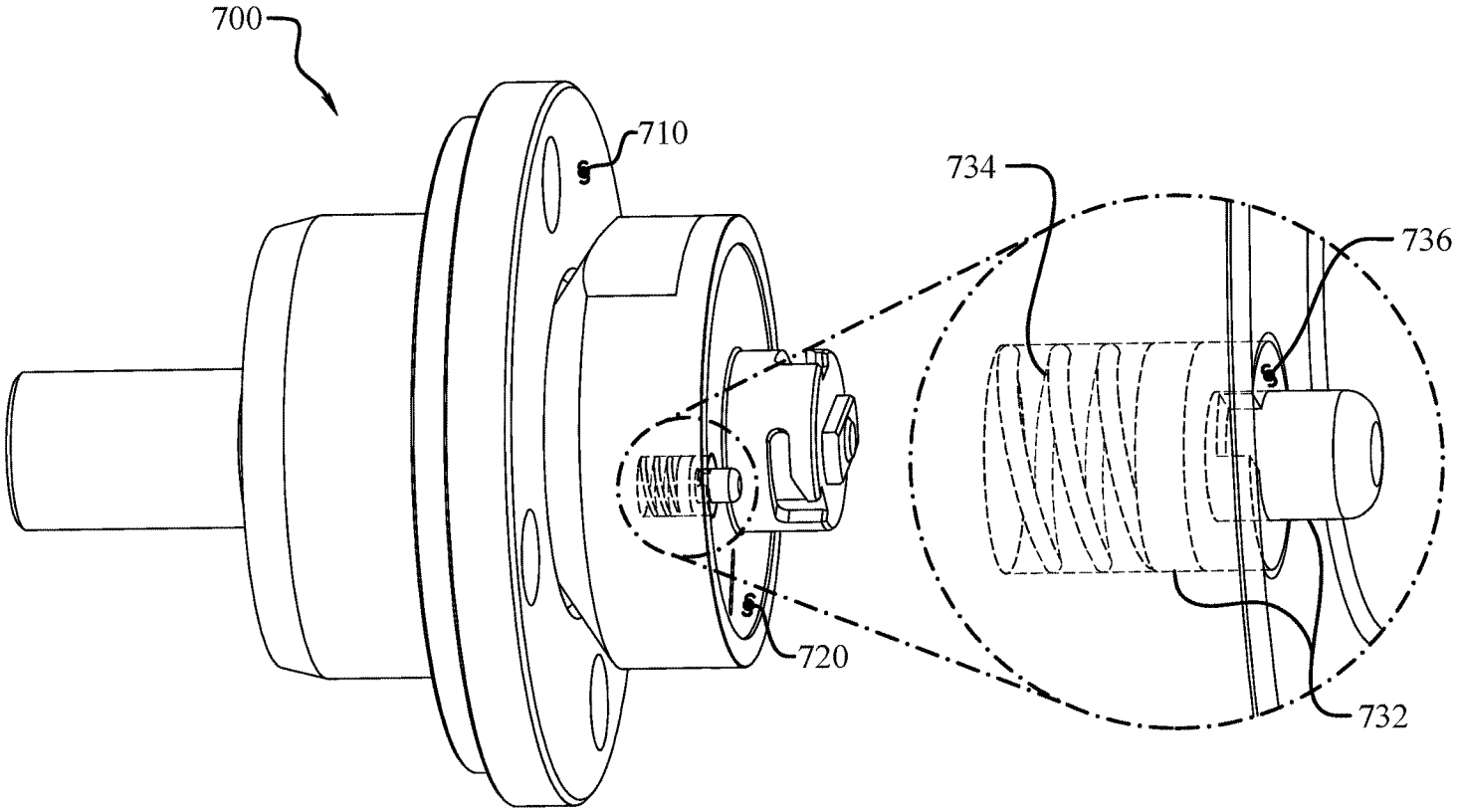
FIG. 14 shows a perspective view of an embodiment of a blade axle.
Figure 29:
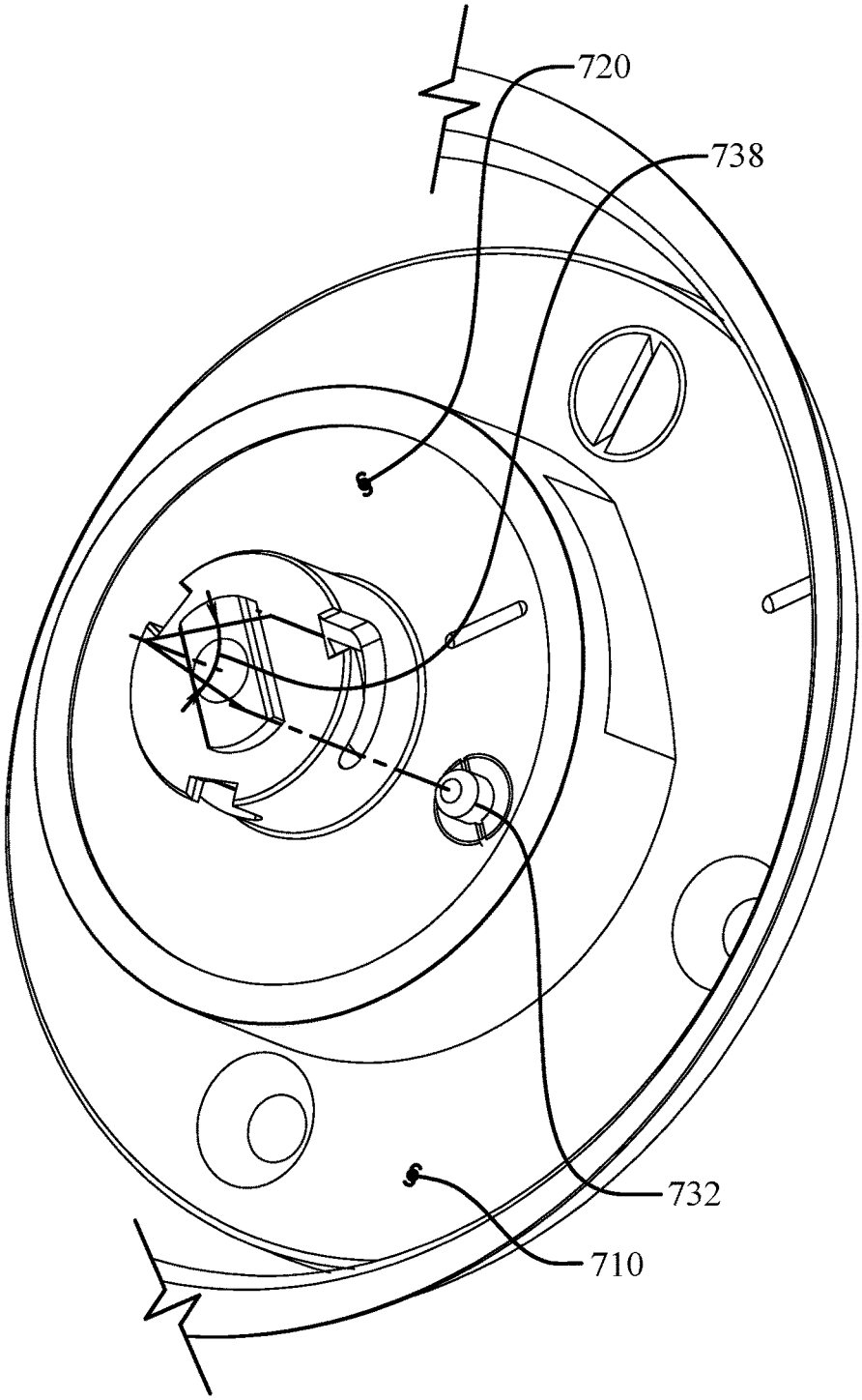
FIG. 29 shows an enlarged perspective view of a portion of FIG. 23 illustrating a portion of an embodiment of a slicer and blade axle, with the blade removed.

In the embodiment of FIG. 13, the at least one mount channel (742) cooperates with the at least one hub engagement protrusion (614), seen best in FIG. 12*b*, and alignment of the at least one hub engagement protrusion (614) with the at least one mount channel (742) permits at least one hub engagement protrusion (614) to (i) translate axially in the at least one mount channel (742) an axial translation distance (744) at an axial translation position, and (ii) achieve relative rotational movement with respect to the blade mount (740) within the at least one mount channel (742), about a blade center, a rotational distance (746) allowing the biased blade locking assembly (730) to engage a receiver (620), seen in FIGS. 12*b* and 12*c*, in the blade (600) or hub (610). In one particular embodiment at least a portion of the biased blade locking assembly (730) extends into the receiver (620) a distance of at least 1/16 inch, while in another embodiment it extends into the receiver (620) a distance of at least 1/8 inch. The biased blade locking assembly (730) is located at an engagement angle (738), seen in FIG. 29, from the axial translation position, establishing a blade operating position, and thereby prevent movement of the at least one hub engagement protrusion (614) within the at least one mount channel (742) until the biased blade locking assembly (730) is disengaged from the receiver (620). The blade axle (700) may include a blade axle mount (710), which is used to secure the blade axle (700) to the slicer.

Finally, a general overview of the blade removal tool (100) is in order. Generally, with reference to FIGS. 1 and 2*a*, the blade removal tool (100) includes a tool base (200), a locking assembly release (510) attached to the tool base (200) and sized to cooperate with the receiver (620) and the biased blade locking assembly (730) to release the biased blade locking assembly (730) from the receiver (620) when the blade removal tool (100) engages the blade (600), and at least one of a blade engagement assembly (300) and/or a blade unlocking assembly (400).

Figure 9:
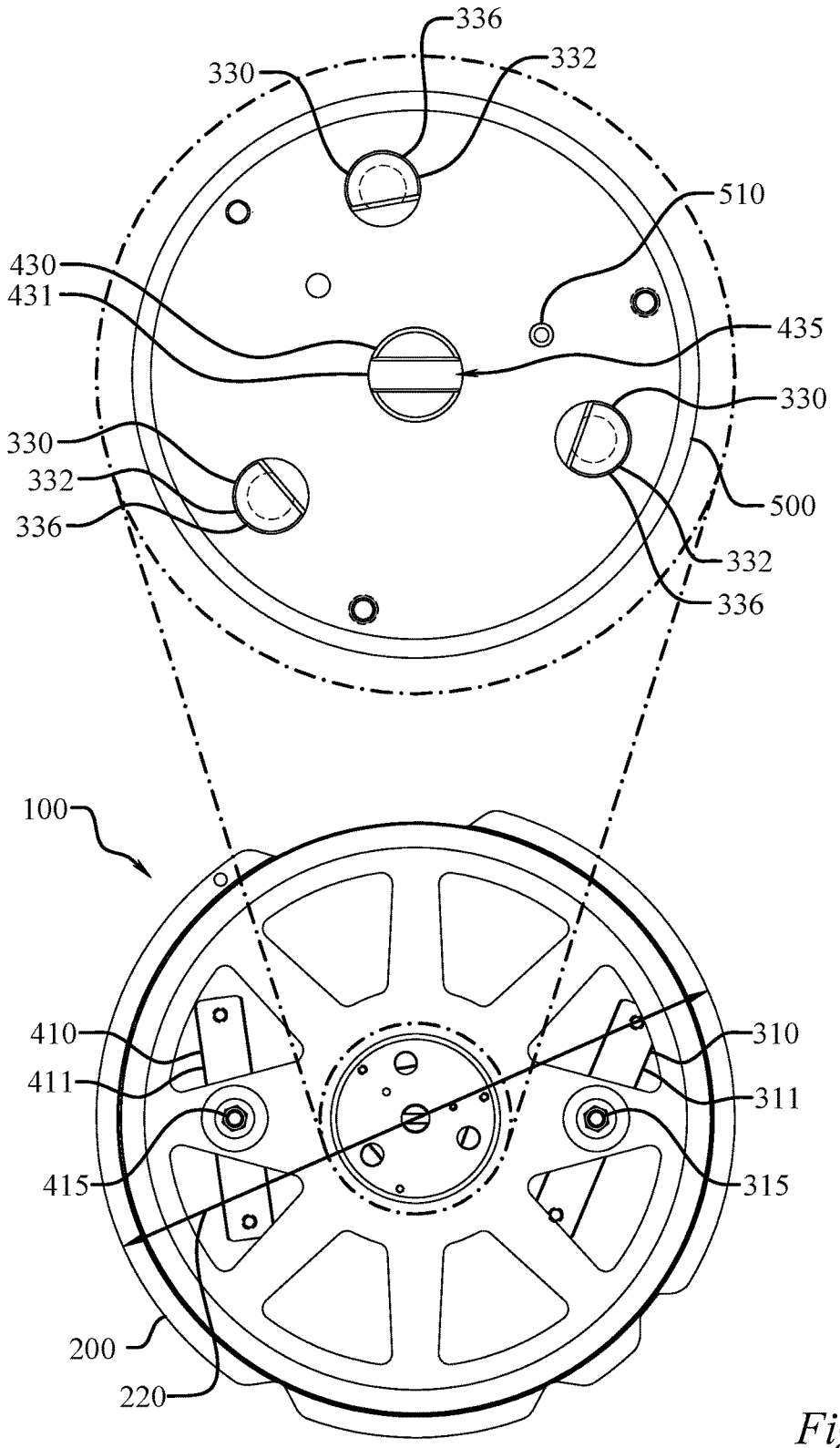
FIG. 9 shows a rear plan view of an embodiment of a blade removal tool.
Figure 10:
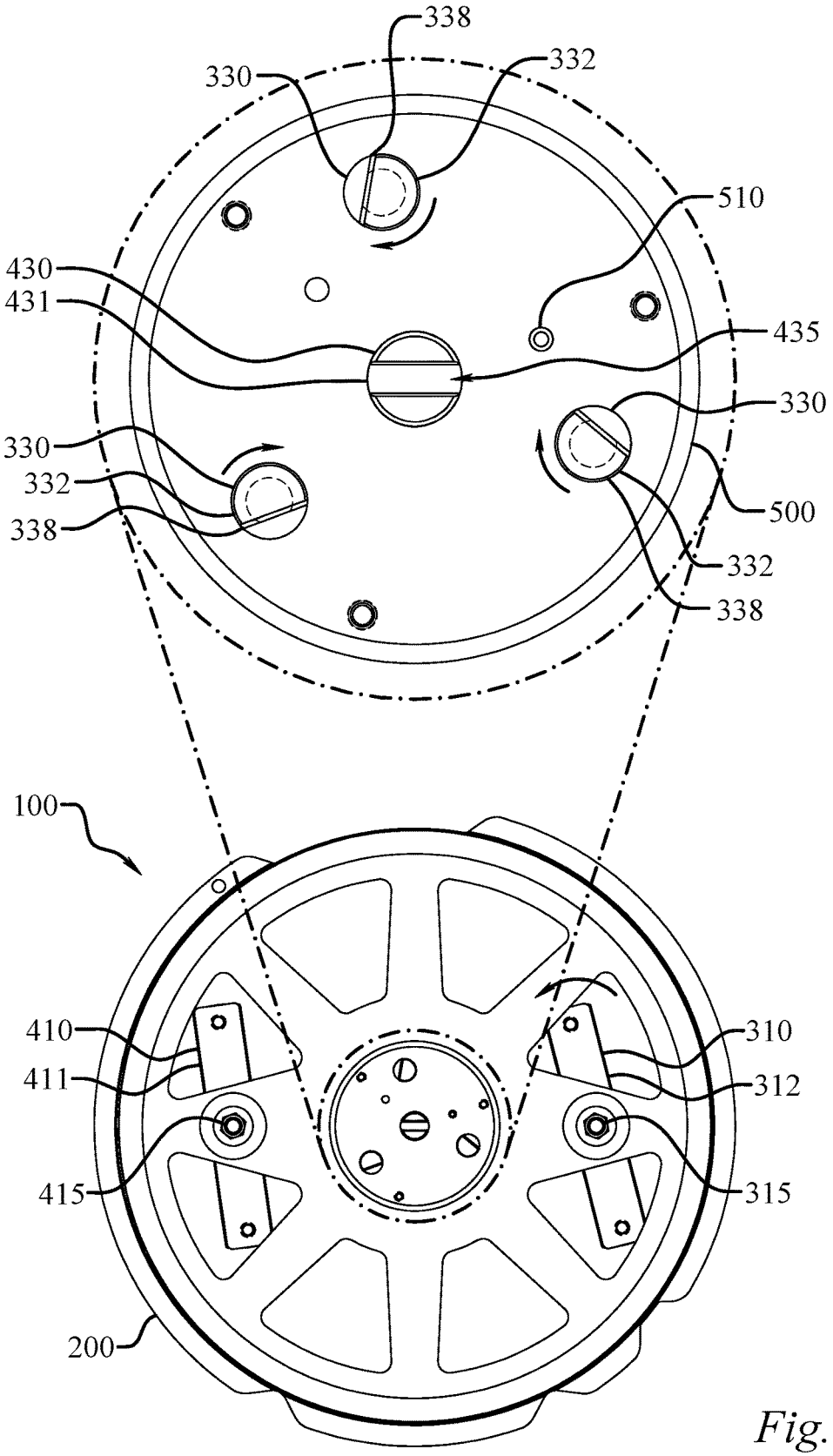
FIG. 10 shows a rear plan view of an embodiment of a blade removal tool.
Figure 11:
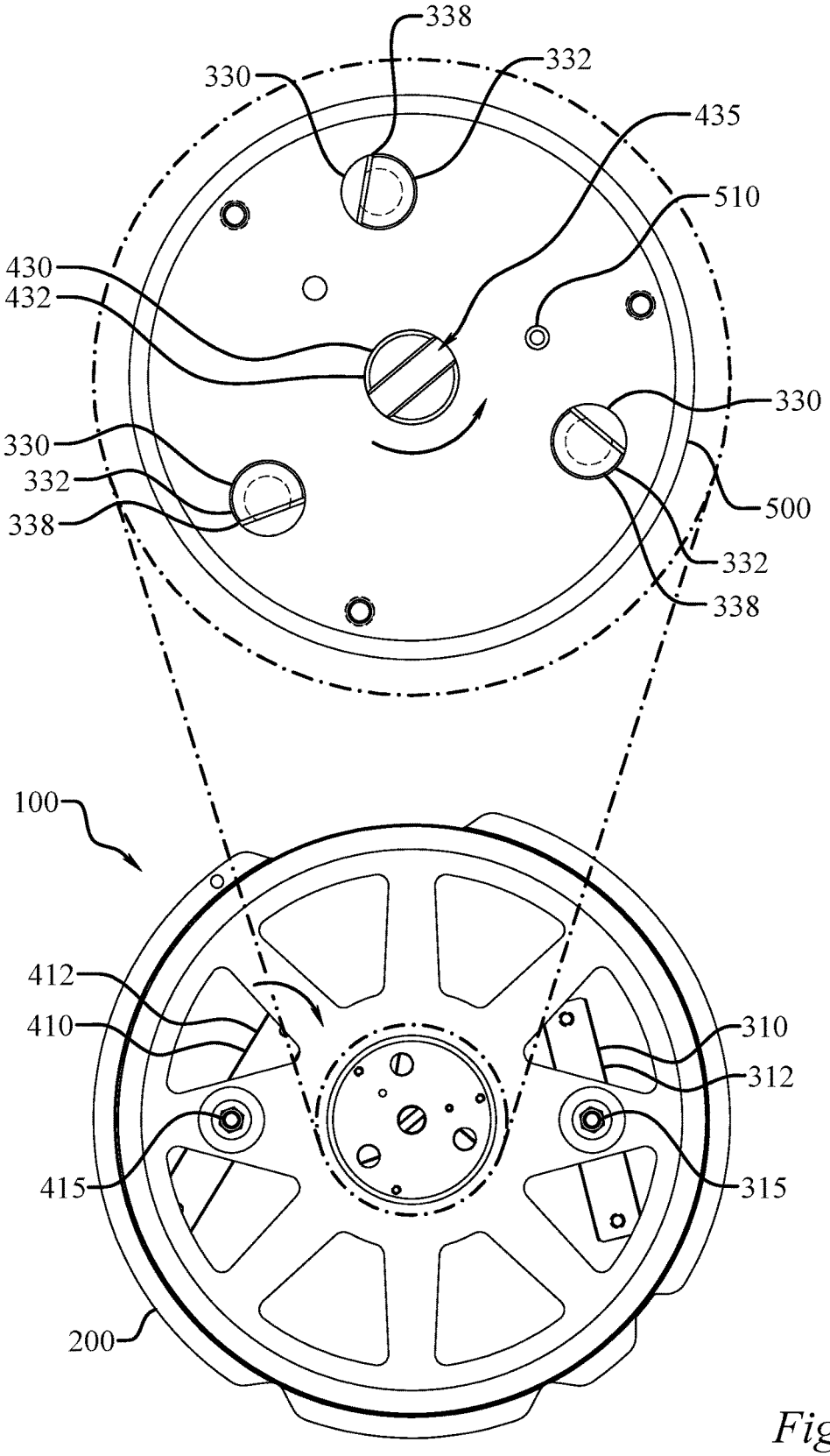
FIG. 11 shows a rear plan view of an embodiment of a blade removal tool.
Figure 33:
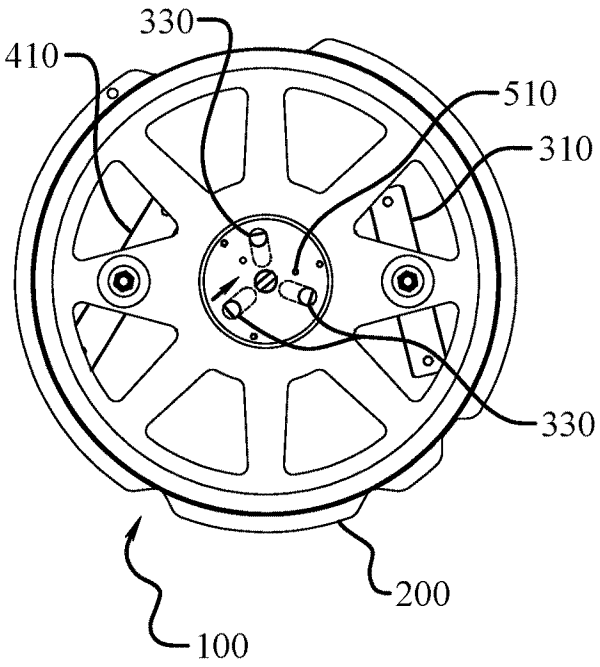
FIG. 33 shows a rear plan view of an embodiment of a blade removal tool illustrating translating blade engagement retainers.
Figure 34:
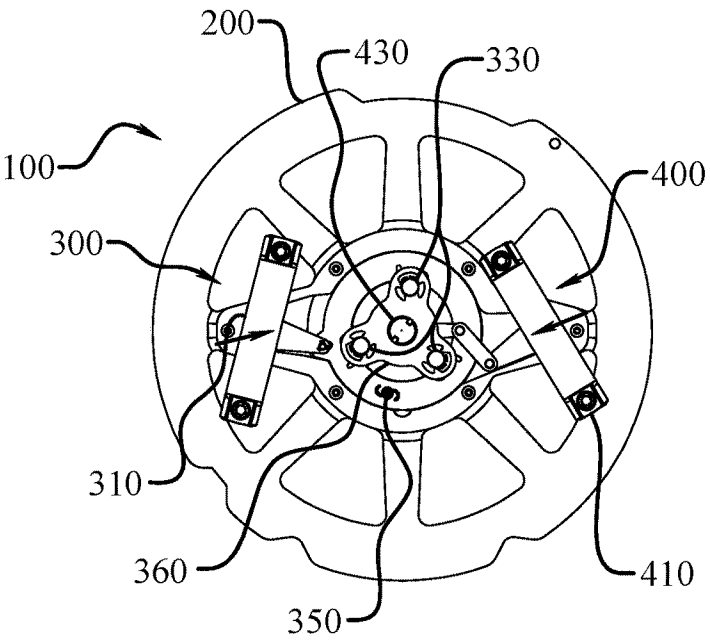
FIG. 34 shows a front plan view of an embodiment of a blade removal tool having a translating blade engagement actuator in a blade engagement actuator initial position, and a translating blade unlocking actuator in a blade unlocking actuator initial position.

The blade engagement assembly (300) is attached to the tool base (200) and has a blade engagement actuator (310) cooperating with at least one blade engagement retainer (330). With reference now to FIGS. 9-11, the cooperation is such that relative movement of the blade engagement actuator (310) with respect to the tool base (200) from a blade engagement actuator initial position (311) to a blade engagement actuator retaining position (312) produces movement of the at least one blade engagement retainer (330) from a retainer initial position (336) to a retainer retaining position (338) whereby at least a portion of the blade engagement retainer (330) has engaged the hub (610) or blade (600) to interlock the tool base (200) and the blade (600). It is important to appreciate that the relative movement of the blade engagement actuator (310) with respect to the tool base (200) may be rotational, as seen in FIGS. 9-11, or translational, as seen in FIG. 34. Similarly, the resulting movement of the at least one blade engagement retainer (330) from a retainer initial position (336) to a retainer retaining position (338) may be rotational, as seen in FIGS. 9-11, or translational, as seen in FIG. 33, independent of whether the movement of the blade engagement actuator (310) is rotational or translational. For example, FIGS. 9 and 10 nicely illustrate an embodiment in which both movements are rotational and will be used as the basis for much of the disclosure, with one skilled in the art appreciating that such disclosure is not limited to these rotational examples and includes equivalents. These figures show the side of the blade removal tool (100) that engages the blade (600), which is why only portions of the blade engagement actuator (310) are seen, but easily understood. FIG. 9 illustrates positions before the blade removal tool (100) engages the blade (600), and FIG. 10 illustrates positions once the blade removal tool (100) has engaged the blade (600). Specifically, in FIG. 9 the blade engagement actuator (310) is in the blade engagement actuator initial position (311), and the three illustrated blade engagement retainers (330) are in the retainer initial position (336), while in FIG. 10 the blade engagement actuator (310) has been moved, in this case rotated, to the blade engagement actuator retaining position (312) and the three illustrated blade engagement retainers (330) have been moved, in this case rotated, to the retainer retaining position (338). While the illustrated embodiments show the at least one blade engagement retainer (330) close to the center of the blade (600), one skilled in the art will appreciate that the at least one blade engagement retainer (330) may be located to engage along the perimeter of the blade (600).

Figure 2A:
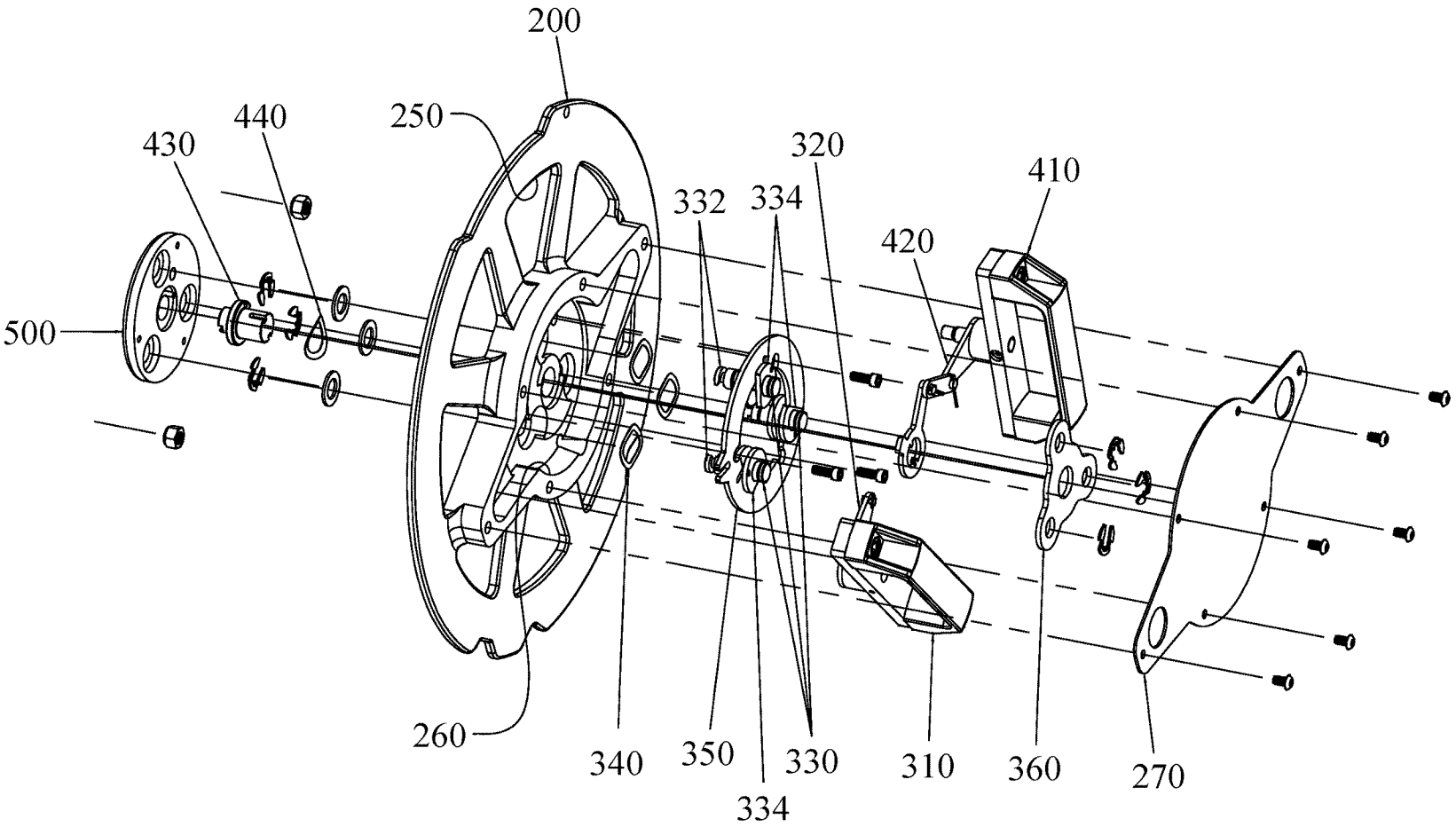
FIG. 2*a* shows an isometric assembly view of components of an embodiment of the safety blade mounting and removal system.

In order to appreciate the big picture some disclosure of an embodiment of the blade engagement retainers (330) is in order with respect to FIG. 12*a*. In one embodiment the blade engagement retainer (330) has a blade engagement retainer flange (332), which extends beyond the tool base (200) so that it can engage the blade (600). However, even though the blade engagement retainer flange (332) may extend beyond the tool base (600), when in the retainer initial position (336) the blade engagement retainer flange (332) is in a position that does not interfere with the blade removal tool (100) engaging the blade (600). Thus, in the specific embodiment of FIGS. 12*a* and 12*b*, in the retainer initial position (336) the blade engagement retainer flange (332) axially passes a portion of the hub (610), and then moves to cooperate with the hub (610), in this case a hub engagement recess (616), in the retainer retaining position (338). With reference now to FIGS. 2*a*, 9, and 10, in one particular embodiment it is easy to appreciate how clockwise rotation of the blade engagement actuator (310) from the blade engagement actuator initial position (311) to the blade engagement actuator retaining position (312), produces rotation of a blade engagement actuator linkage (320), which may include multiple sections, and a drive plate (350), that cooperates with a retainer sequential control member (334), or an appendage thereof, of the blade engagement retainer (330) to cause rotation that then moves the blade engagement retainer flange (332) into the hub engagement recess (616) thereby securing the blade removal tool (100) to the blade (600), specifically the hub (610) in this embodiment. In one embodiment the outer periphery of the hub (610) defines a hub diameter (612), as seen in FIG. 12*b*, which is preferably less than 6 inches, while in another embodiment it is less than 5 inches, and in yet a further embodiment it is less than 4 inches.

In yet another embodiment the at least one blade engagement retainer (330) may be biased so that it must be partially displace axially in order to engage the blade (600) or hub (610). As shown in FIG. 1, such biasing may be achieved with a blade engagement retainer bias spring (340) so that it is biased away from the blade (600) and rotation of the blade engagement retainer (330) requires a flange biasing ramp (333) of the blade engagement retainer flange (332), seen in FIG. 12*a*, to cooperate with a portion of the hub engagement recess (616), seen in FIG. 12*b*), and axially displace the blade engagement retainer (330) as it is rotated. In an alternative embodiment a portion of the hub engagement recess (616) has a biasing ramp to result in the axial displacement of the blade engagement retainer (330) as the blade engagement retainer flange (332) is rotated into the hub engagement recess (616); while in an even further embodiment both the blade engagement retainer flange (332) and the hub engagement recess (616) have a biasing ramp. Such biasing results in a secure connection between the blade engagement retainer flange (332) and the blade (600) or hub (610), reducing the likelihood that the blade engagement retainer flange (332) is inadvertently rotated out of engagement. In one embodiment this axial displacement is at least 1/32 inch, while in another embodiment it is at least 1/16 inch.

Figure 36:
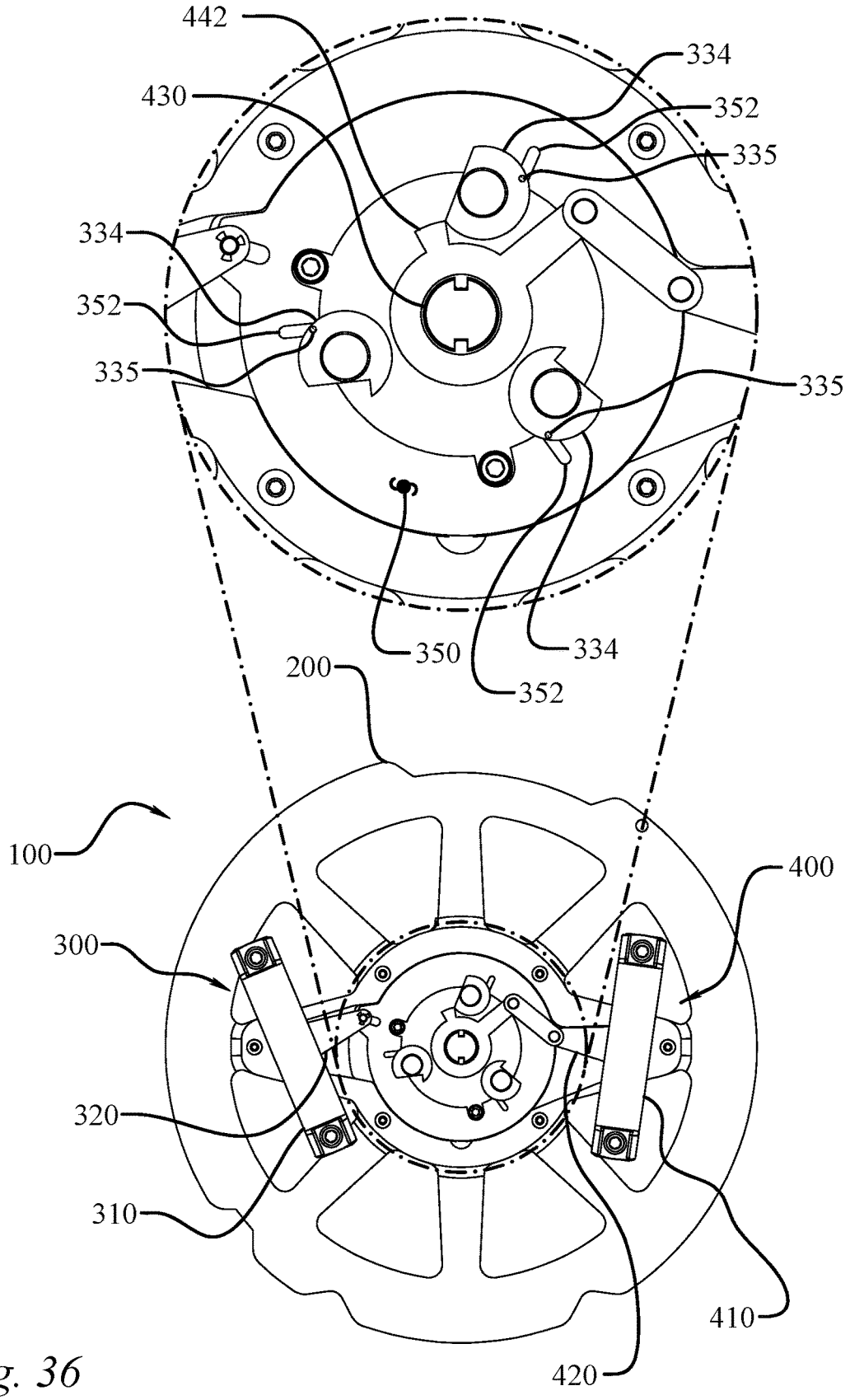
FIG. 36 shows a front plan view of an embodiment of a blade removal tool with the blade engagement cover plate removed to illustrate the configuration of components with the blade engagement actuator in a blade engagement actuator initial position and the blade unlocking actuator in a blade unlocking actuator initial position, wherein the retainer sequential control member is blocking a blocking spur to prevent movement of the blade unlocking actuator.
Figure 37:
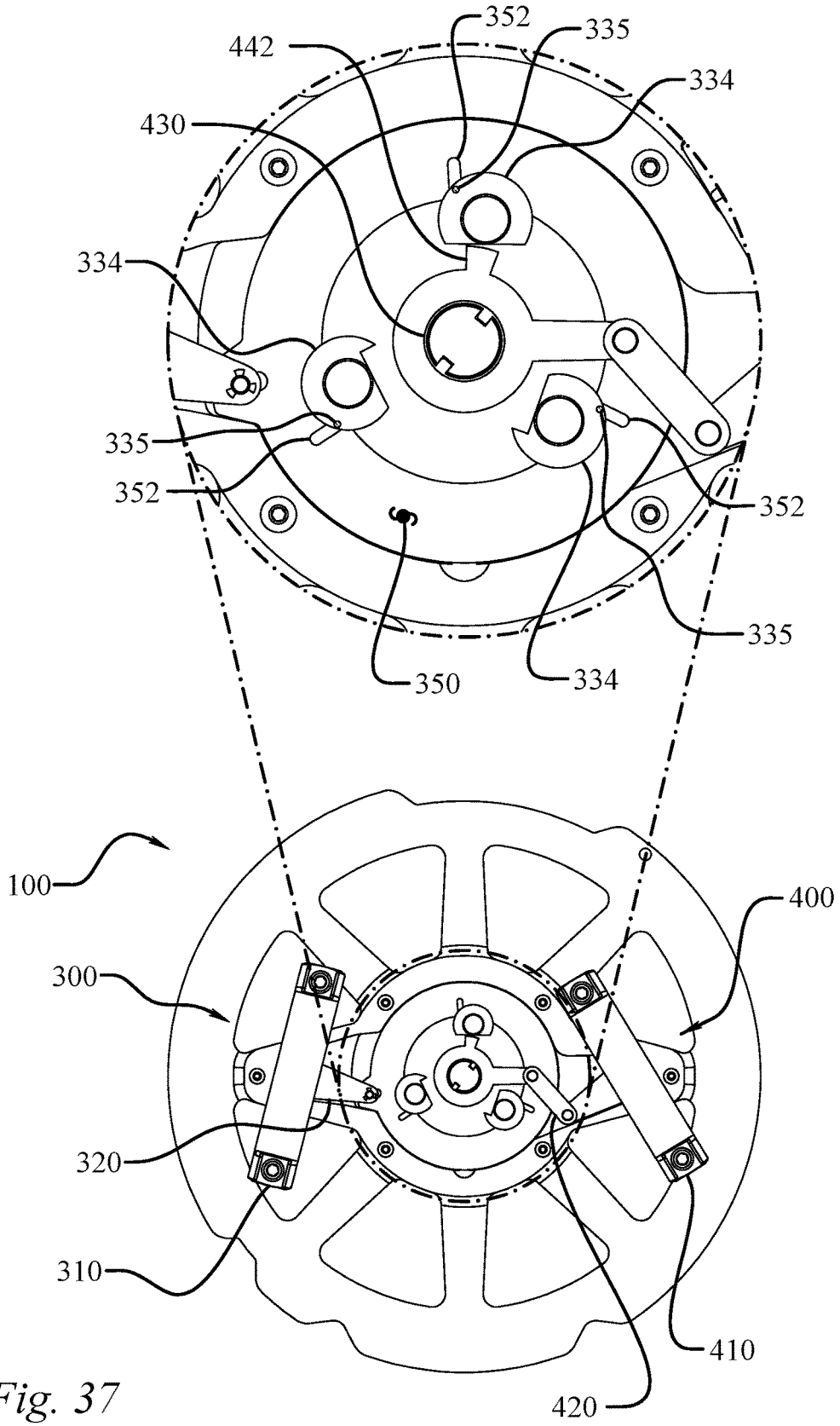
FIG. 37 shows a front plan view of an embodiment of a blade removal tool with the blade engagement cover plate removed to illustrate the configuration of components with the blade engagement actuator in a blade engagement actuator retaining position and the blade unlocking actuator in a blade unlocking actuator release position, wherein the blocking spur is preventing movement of the retainer sequential control member and the blade engagement actuator.

In the embodiment of FIG. 36, the cooperation of the drive plate (350) and the blade engagement retainer (330) is provided by a drive appendage (335) connected to the retainer sequential control member (334), wherein the drive appendage (335) travels within a drive plate guide (352) as the drive plate (350) rotates, thereby resulting in movement of the drive appendage (335) and rotation of the retainer sequential control member (334) and the blade engagement retainer (330). One skilled in the art will appreciate an alternative embodiment, not illustrated but easily understood, wherein the cooperation of the drive plate (350) and the blade engagement retainer (330) is provided by an appendage connected to the drive plate (350), instead of the retainer sequential control member (334), and a guide associated with the retainer sequential control member (334), instead of the drive plate (350). Further, the cooperation between the drive plate (350) and the blade engagement retainer (330) may include any equivalent method of transmitting the desired motion including, but not limited to, the meshing of cooperating teeth, or other geometries, as well as cooperation of one or more cams. As seen in FIG. 1, in one specific embodiment the blade engagement actuator (310) is rotably attached to the tool base (200) with a blade engagement actuator fastener (315).

Now looking specifically at the blade unlocking assembly (400), it is attached to the tool base (200) and has a blade unlocking actuator (410) cooperating with a blade unlocking post (430). With reference now to FIGS. 9-11, the cooperation is such that relative movement of the blade unlocking actuator (410) with respect to the tool base (200) from a blade unlocking actuator initial position (411) to a blade unlocking actuator release position (412) produces rotation of the blade unlocking post (430) from a post initial position (431), seen in FIG. 9, to a post release position (432), seen in FIG. 10. For example, FIGS. 9 and 10 nicely illustrate an embodiment in which the blade unlocking actuator (410) is rotably attached to the tool base (200) and rotates counterclockwise from the blade unlocking actuator initial position (411) to the blade unlocking actuator release position (412), and resulting in rotation of the blade unlocking post (430) from the post initial position (431) of FIG. 9 to the post release position (432) of FIG. 10, with one skilled in the art appreciating that such disclosure is not limited to these rotational examples. These figures show the side of the blade removal tool (100) that engages the blade (600), which is why only portions of the blade unlocking actuator (410) are seen, but easily understood. FIG. 9 illustrates positions before the blade removal tool (100) engages the blade (600), and FIG. 10 illustrates positions once the blade removal tool (100) has engaged the blade (600). Specifically, in FIG. 9 the blade unlocking actuator (410) is in the blade unlocking actuator initial position (411), and the illustrated blade unlocking post (430) is in the blade post initial position (431), while in FIG. 10 the blade unlocking actuator (410) has been moved, in this case rotated, to the blade unlocking actuator release position (412) and the illustrated blade unlocking post (430) has been moved, in this case rotated, to the post release position (432). With reference now to FIGS. 2*a*, 9, and 10, in one particular embodiment it is easy to appreciate how counter-clockwise rotation of the blade unlocking actuator (410) from the blade unlocking actuator initial position (411) to the blade unlocking actuator release position (412), produces rotation of a blade unlocking linkage (420), which may include multiple sections, that cooperates with the blade unlocking post (430) to result in its rotation. As seen in FIG. 1, in one specific embodiment the blade unlocking actuator (410) is rotably attached to the tool base (200) with a blade unlocking actuator fastener (415).

The significance of the rotation of the blade unlocking post (430) is that it cooperates with the blade mount (740) so that rotation of the blade unlocking post (430) produces rotation of the blade mount (740) with respect to the blade (600), and associated movement of the at least one hub engagement protrusion (614) within the at least one mount channel (742) from the blade operating position to re-align the at least one hub engagement protrusion (614) with the axial translation position and permit the blade (600) to be axially pulled, with the blade removal tool (100), from the blade mount (740). Cooperation of the blade unlocking post (430) and the blade mount (740) may be accomplished in many ways. In one particular embodiment the end of the blade unlocking post (430) has a post engager (435), and the blade mount (740) has a blade mount engager (748), wherein the post engager (435) and the blade mount engager (748) cooperate to transmit rotation from one to the other. In the embodiments of FIGS. 9 and 13, the post engager (435) is a recess that receives the blade mount engager (748), which is a projection. However, the design is not limited to this configuration and the recess and projection configuration may be the opposite, or the interface may include any cooperating configuration that will transmit rotation including, but not limited to, a key and keyway configuration. At this point one should appreciate that in this embodiment the blade removal tool (100) has been brought in proximity to the blade (600) such that the locking assembly release (510) has released the biased blade locking assembly (730), and the at least one blade engagement retainer (330) has interlocked the blade removal tool (100) and the blade (600). Thus, in this embodiment the blade removal tool (100) is not rotated but is held in place as the blade unlocking post (430) rotates within it resulting in rotation of the blade mount (740) relative to the stationary blade (600). Therefore, with reference to FIG. 13, in this embodiment the blade mount (740) rotates relative to the stationary at least one hub engagement protrusion (614) until it is in a position that it may be axially translated by a user pulling on the blade removal tool (100) so that the blade (600) may slide off the blade mount (740).

Figure 6:
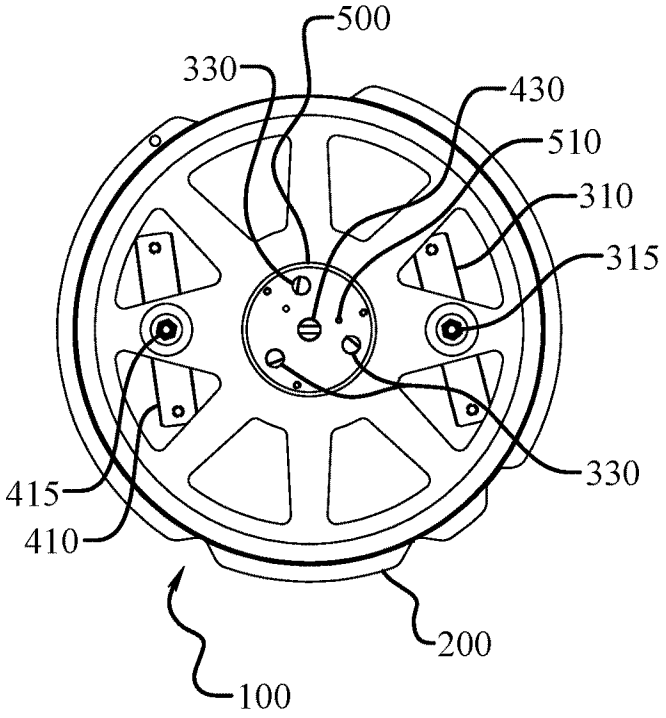
FIG. 6 shows a rear plan view of an embodiment of a blade removal tool.
Figure 5:
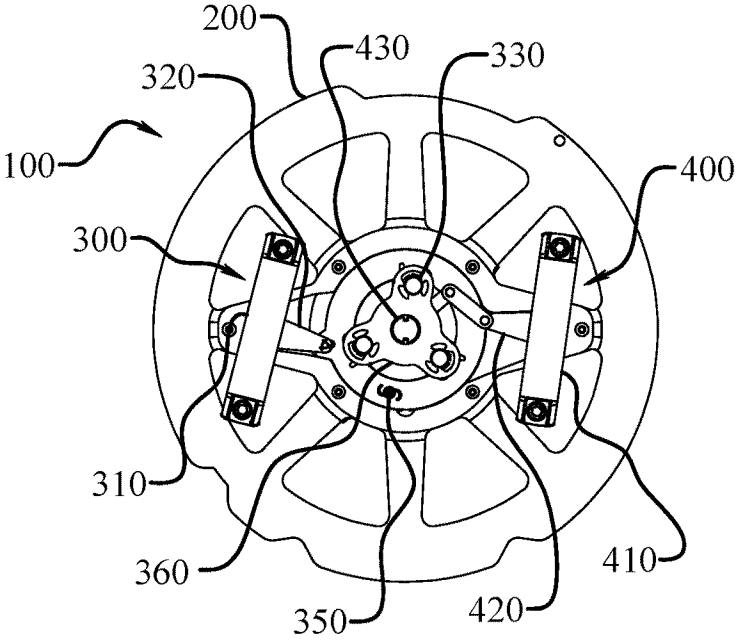
FIG. 5 shows a front plan view of an embodiment of a blade removal tool.
Figure 8:
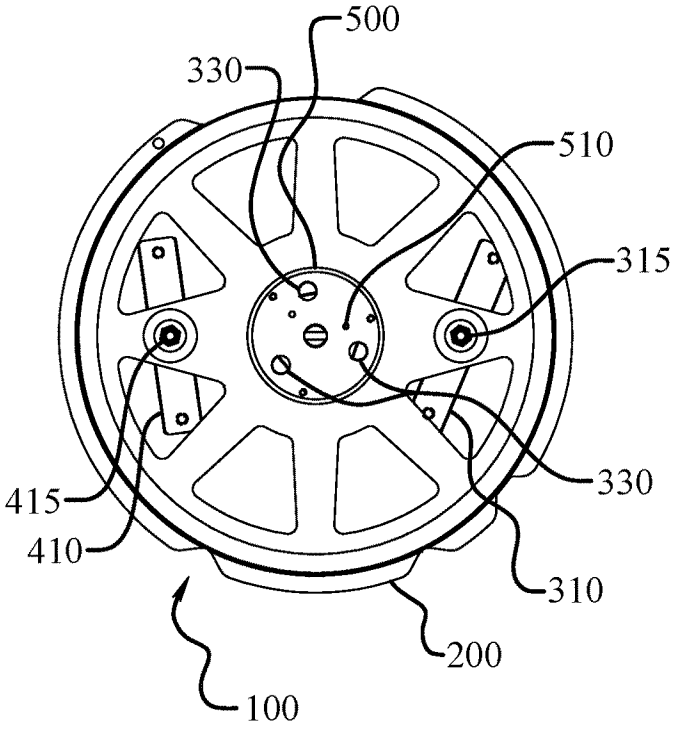
FIG. 8 shows a rear plan view of an embodiment of a blade removal tool.
Figure 7:
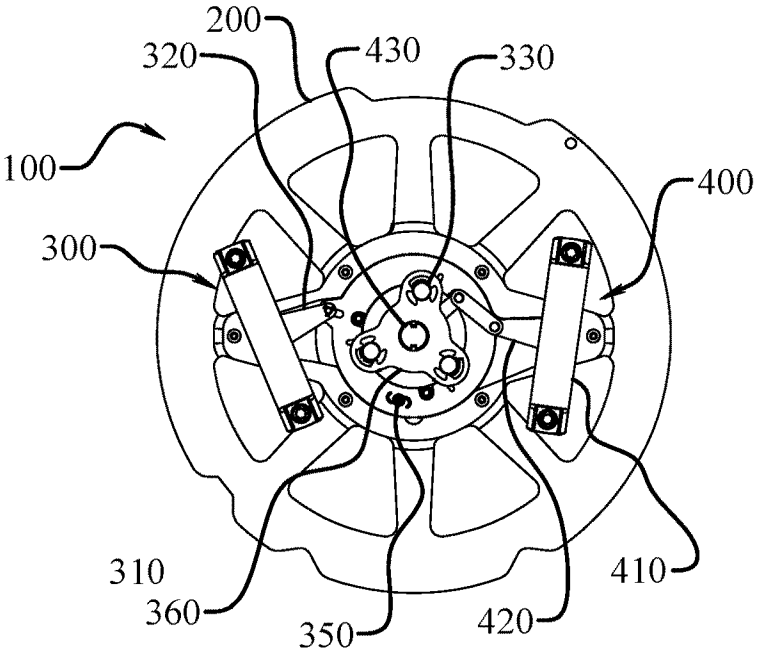
FIG. 7 shows a front plan view of an embodiment of a blade removal tool.

In one embodiment safety is further improved by having the blade engagement assembly (300) and the blade unlocking assembly (400) cooperate so that relative movement of the blade unlocking actuator (410) cannot occur unless the blade engagement actuator (310) is in the blade engagement actuator retaining position (312), and therefore the blade (600) cannot be removed from the blade mount (740) unless it has already been secured to the blade removal tool (100) by the at least one blade engagement retainer (330). In yet a further embodiment improving the safety of the blade removal tool (100), relative movement of the blade engagement actuator (310) cannot occur when the blade unlocking actuator (410) is in the blade unlocking actuator release position (412), thereby ensuring that once the blade (600) has been removed from the slicer and is attached to the blade removal tool (100), the at least one blade engagement retainer (330) cannot be moved to release the blade (600) from the blade removal tool (100) until the blade unlocking actuator (410) is returned to the blade unlocking actuator initial position (411). These embodiments require sequenced movement of both the blade engagement actuator (310) and the blade unlocking actuator (410) to secure the blade (600) to the removal tool (100) and remove the blade (600) from the slicer, and requiring sequenced movement of both the blade engagement actuator (310) and the blade unlocking actuator (410) to release the blade (600) from the removal tool (100). Such sequenced movement may be accomplished in a number of ways, at least one of which is disclosed in detail, however this is just one illustrative non-limiting example and any number of blocking elements, spurs, or equivalents may be incorporated into the blade engagement actuator linkage (320), the blade unlocking linkage (420), the drive plate (350), and/or the blade engagement retainer (330) to meet the described sequential movement and/or locking of the components. For instance, in the embodiment illustrated in FIGS. 36 and 37 the blade unlocking linkage (420) include a blocking spur (422) that cooperates with the retainer sequential control member (334) to achieve the desired sequential movement of components. In this example, when the blade unlocking actuator (410) is in the blade unlocking actuator initial position (411), the blocking spur (422) is out of the way and does not influence the movement of the blade engagement actuator (310), however the retainer sequential control member (334) blocks movement of the blade unlocking actuator (410) by trapping the blocking spur (422) until the blade engagement actuator (310) has been moved to the blade engagement actuator retaining position (312), thereby rotating the retainer sequential control member (334) so that the blocking spur (422) is no longer trapped and allowing movement of the blade unlocking actuator (410) to the blade unlocking actuator release position (412). Likewise, when the blade unlocking actuator (410) is in the blade unlocking actuator release position (412), the blocking spur (422) has been moved to a position that prevents rotation of the retainer sequential control member (334), and thus the blade engagement actuator (310). Thus, FIGS. 7, 8, 9, and 36 illustrate the arrangement of components of an embodiment when the blade engagement actuator (310) is in the blade engagement actuator initial position (311) and the blade unlocking actuator (410) is in the blade unlocking actuator initial position (411); while FIGS. 3, 4, 11, and 37 illustrate the arrangement of components of an embodiment when the blade engagement actuator (310) is in the blade engagement actuator retaining position (312) and the blade unlocking actuator (410) is in the blade unlocking actuator release position (412); and FIGS. 5, 6, and 10 illustrate the arrangement of components of an embodiment when the blade engagement actuator (310) is in the blade engagement actuator retaining position (312) but the blade unlocking actuator (410) has not yet been moved from the blade unlocking actuator initial position (411). Further, the blade (600) removal process of an embodiment is illustrated by the sequence shown in FIGS. 17-23, and the blade (600) installation process of on an embodiment is illustrated by the sequence shown in FIGS. 23-38.

In yet another embodiment further improving the safety of the blade removal tool (100), the blade unlocking actuator (410) is locked in place once in the blade unlocking actuator release position (412), and a release mechanism (475), separate from the blade engagement actuator (310) and the blade unlocking actuator (410), must be activated to release the blade unlocking actuator (410). Therefore in this embodiment sequenced movement of both the blade engagement actuator (310) and the blade unlocking actuator (410) is not enough to release the blade (600) from the removal tool (100) because the fixation of the blade unlocking actuator (410) also prevents movement of the blade engagement actuator (310), rather the blade removal tool (100) includes a release mechanism (475) that must be activated before subsequent movement of the blade engagement actuator (310) and the blade unlocking actuator (410) is possible. Further, such fixation of the blade engagement actuator (310) and the blade unlocking actuator (410) when the blade removal tool (100) is retaining the blade (600) aids in the safety of transporting the blade (600), as a commercial blade (600) is often greater than 12 inches in diameter and can weigh several pounds, and the fixed actuators provide stable gripping points when handling this load. Additionally, the release mechanism (475) is not limited to the prior description whereby it locks the blade unlocking actuator (410), which in some embodiments also results in securing the blade engagement actuator (310) in place, rather the release mechanism (475) may lock the blade engagement actuator (310) in place, which in yet another embodiment may also secure the blade unlocking actuator (410) in place. Yet another embodiment incorporates at least two release mechanisms (475), namely one associated with the blade engagement actuator (310) and a separate one associated with the blade unlocking actuator (410).

Figure 31:
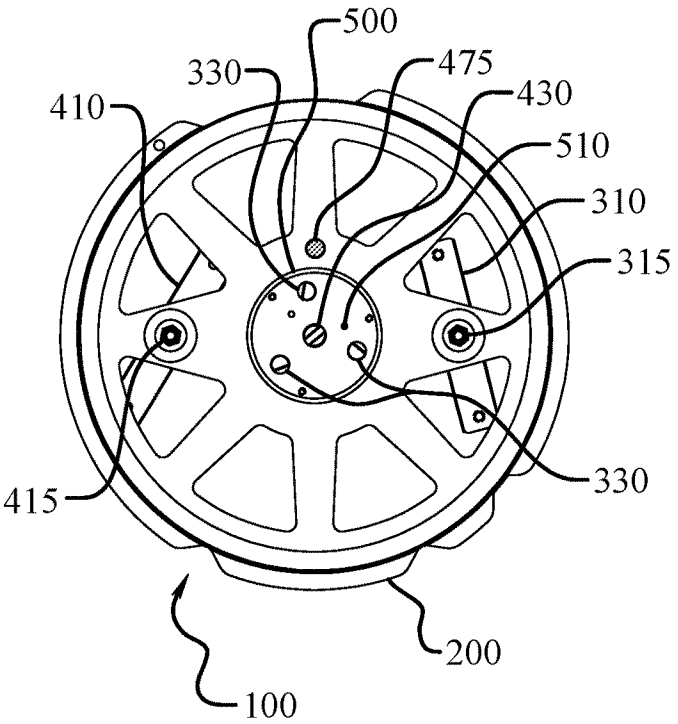
FIG. 31 shows a rear plan view of an embodiment of a blade removal tool with a release mechanism located on the rear side of the blade removal tool.
Figure 30:
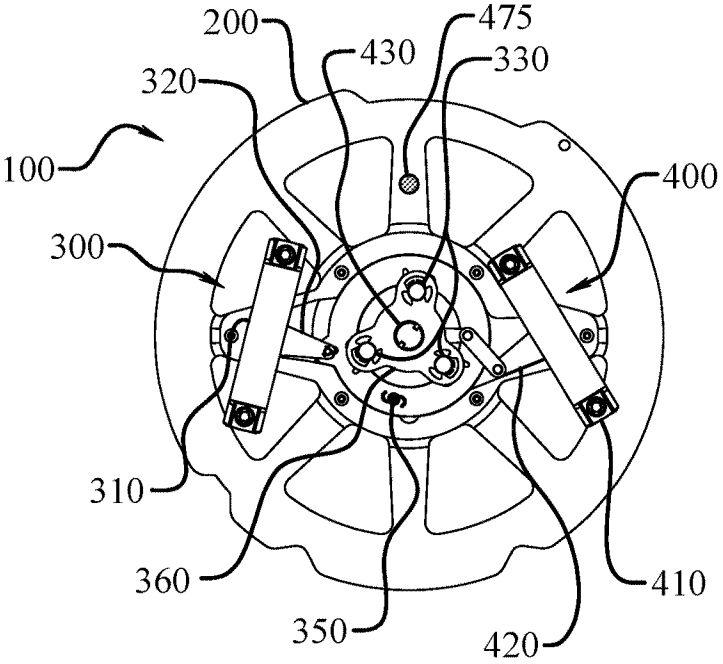
FIG. 30 shows a front plan view of an embodiment of a blade removal tool with a release mechanism located on the front side of the blade removal tool.
Figure 32:
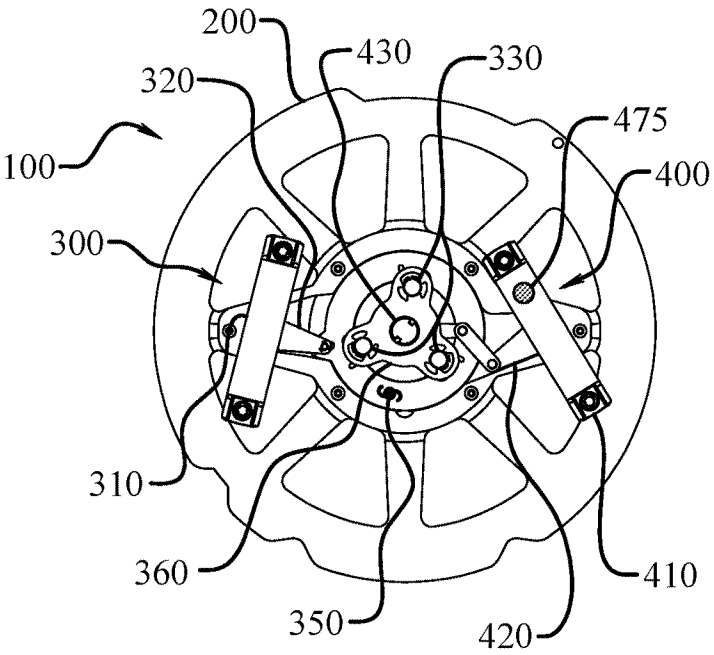
FIG. 32 shows a front plan view of an embodiment of a blade removal tool with a release mechanism located on the blade unlocking actuator.
Figure 35:
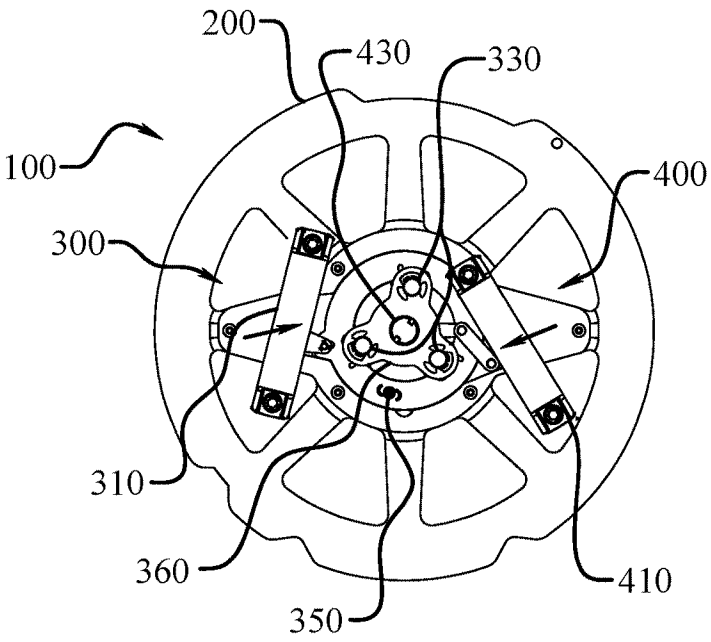
FIG. 35 shows a front plan view of an embodiment of a blade removal tool having a translating blade engagement actuator in a blade engagement actuator retaining position, and a translating blade unlocking actuator in a blade unlocking actuator release position.

Such a release mechanism (475) may be located anywhere on the blade removal tool (100), such as either side of the tool base (200), as seen in FIGS. 30 and 31, or on either, or both, of the blade engagement actuator (310) and the blade unlocking actuator (410), as seen in FIG. 32, however selective placement of the release mechanism (475) may further improve the safety of the blade removal process. For instance, in one embodiment the release mechanism (475) requires a force is applied to the blade removal tool (100) on the side opposite the blade engagement actuator (310) and the blade unlocking actuator (410), thereby reducing the likelihood that a user could be holding the blade removal tool (100) interlocked with the blade (600) and apply the required force to the release mechanism (475) located on the other side of the blade removal tool (100). In a further embodiment activation of the release mechanism (475) is based upon position, which may be contact or non-contact based, rather than force. The release mechanism (475) may be mechanical, electrical, electromechanical, magnetic, electromagnetic, optical, radio-frequency identification (RFID), and equivalents. For example, the release mechanism (475) may include a RFID tag reader and a portion of the slicer may have a passive RFID tag such that the release mechanism (475) only permits movement of the blade engagement actuator (310) and/or the blade unlocking actuator (410) when the blade removal tool (100) is in a position such that the tag reader recognizes the passive RFID tag; and one skilled in the art will appreciate that other optical and magnetic systems could perform in a similar manner.

Such embodiments having the release mechanism (475) located on the side of the blade removal tool (100) opposite the blade engagement actuator (310) and the blade unlocking actuator (410) provide another opportunity to require cooperation between the blade removal tool (100) and the blade axle (700), blade (600), and/or the slicer in general. For instance, in one particularly efficient embodiment the blade unlocking post (430) is the release mechanism (475). In one such embodiment the blade unlocking post (430) is biasedly mounted within the tool base (200) such that the blade unlocking post (430) must be moved from its biased position, in this case depressed, by contact with the blade mount (740), upon engagement of the blade removal tool (100) with the blade (600), in order to permit movement of the blade unlocking actuator (410). Thus, the axial movement of the blade unlocking post (430) serves as the activation of the release mechanism (475). One such embodiment is seen in FIG. 2*a* and includes a post bias spring (440) that biases the blade unlocking post (430) outward, or in the illustrated embodiment toward a center plate (500), and in further embodiment the engagement, or lack of engagement, of the unlocking post (430) with the center plate (600), tool base (200), and/or blade unlocking linkage (420) prevents rotation until depressed. One skilled in the art will appreciate the numerous ways this selective rotation control may be accomplished, including, but not limited to, post and recess configurations, key and keyway configurations, cooperating meshing teeth or other geometries, as well as via one or more cams, and equivalents. Thus, like the blade engagement actuator linkage (320), the blade unlocking linkage (420) is not limited to a linkage in the traditional sense but may include equivalents that produces the movements disclosed herein and may include elements with interlocking aspects, such as teeth or other cooperating geometries, one or more cams, and equivalents. The center plate (500) is not necessary, but improves the manufacturability of the blade removal tool (100) and may further contain apertures to allow passage of the at least one blade engagement retainer (330) and blade unlocking post (430), as well as a recess for a post bias spring (440), and serve as a convenient mount for the locking assembly release (510), as seen in FIG. 1.

In the embodiment illustrated in FIG. 2*a* a portion of the blade unlocking linkage (420) engages the blade unlocking post (430) when depressed and may impart rotation. In this specific embodiment a portion of the blade unlocking linkage (420) is positioned such that when the unlocking post (430) is depressed a portion of the blade unlocking linkage (420) encircles the unlocking post (430) and at least one projection from the blade unlocking linkage (420) engages a channel in the unlocking post (430) so that rotation can be transmitted. One skilled in the art will appreciate numerous additional ways that the blade unlocking linkage (420) and the blade unlocking post (430) may cooperate to enable rotation of the blade unlocking post (430) when depressed, including, but not limited to, a recess in the end of the blade unlocking post (430) that receives and interlocks with a portion of the blade unlocking linkage (420) when the blade unlocking post (430) is depressed, and equivalents. In yet a further alternative embodiment the blade unlocking actuator (410) may be biased such that a user must apply an axial force to it to increment a portion of the blade unlocking linkage (420) into cooperation with the blade unlocking post (430) and enable rotation. Similarly, in yet another embodiment the blade engagement actuator (310) and/or the at least one blade engagement retainer (330) may be biased such that an axial force must be applied by the user to the blade engagement actuator (310) in order to extend the at least one blade engagement retainer (330) from the tool base (200) and/or present the at least one blade engagement retainer (330) into a position that it may engage the blade (600). In one embodiment the axial movement of the unlocking post (430) required for engagement is at least 1/32 inch, while in another embodiment it is at least 1/16 inch, in an even further embodiment it is no more than 6¼ inch, and in still another embodiment it is no more than ⅛ inch.

In another embodiment, seen in FIG. 12*b*, the at least one hub engagement protrusion (614) is biased, which is why it is illustrated as at least one finger extending from a ring that is received in a recess of the hub (610) and sandwiched between the blade (600) and the hub (610), with a protrusion biasing member (615) illustrated as a spring in FIG. 1. In this configuration, once the at least one hub engagement protrusion (614) is aligned with a channel axial aspect (743) of the mount channel (742), seen in FIG. 13, a user must apply an axial force to axially displace the at least one hub engagement protrusion (614) so that it may have relative movement in a channel rotational aspect (745) of the mount channel (742). During installation the hub engagement protrusion (614) is moved from an initial biased position to an installation position, and in one embodiment this axial displacement is at least 1/16 inch, while in another embodiment it is at least ⅛ inch. In one embodiment the mount channel (742) may include a channel displacement ramp (747) so that the rotation of the blade mount (740) can assist in the axial displacement of the biased hub engagement protrusion (614). In one particular embodiment the channel axial aspect (743) has an axial translation distance (744), seen in FIG. 13, and the channel rotational aspect (745) has a rotational distance (746), wherein the rotational distance (746) is greater than the axial translation distance (744), thereby ensuring adequate relative motion is required to achieve engagement of the biased blade locking assembly (730) and prevent unintentional disengagement of the blade (600). In fact this goal is further achieve in another embodiment that expresses an angular relationship between the centerline location of the biased blade locking assembly (730) with the centerline of the entry point of the mount channel (742), as illustrated by an engagement angle (738) seen in FIG. 29. In one such embodiment the engagement angle (738) is at least 5 degrees, in a further embodiment the engagement angle (738) is no more than 60 degrees, while in another embodiment the engagement angle (738) is at least 10 degrees, and in yet an even further embodiment the engagement angle (738) is no more than 45 degrees.

Some embodiments are specifically designed to require a user to utilize both hands on the blade removal tool (100) at the same time, thereby reducing the likelihood of unintentionally, or intentionally, contacting the blade (600). In one such embodiment the blade engagement actuator (310) and the blade unlocking actuator (410) are spaced apart from one another on the blade removal tool (100) a separation distance of at least 3 inches so that they cannot be operated simultaneously with a single hand. In yet another embodiment a first direction of motion of the blade engagement actuator (310) with respect to the tool base (200) is not parallel to a second direction of motion of the blade unlocking actuator (410) with respect to the tool base (200), as illustrated by the straight arrows in FIG. 34 indicating the direction of travel. Thus, even if an individual had extremely large hands it would be unlikely they could manipulate the actuators with a single hand. Still further, in another embodiment the blade engagement actuator (310) is rotationally attached to the tool base (200), and the blade unlocking actuator (410) is rotationally attached to the tool base (200), and the direction of rotation of the blade engagement actuator (310) that produces movement of the at least one blade engagement retainer (330) from the retainer initial position (336) to the retainer retaining position (338) is opposite the direction of rotation of the blade unlocking actuator (410) that produces rotation of the blade unlocking post (430) from the post initial position (431) to the post release position (432), as illustrated in FIGS. 10 and 11, while in an even further embodiment both of these directions of rotation are toward the center of the blade (600).

The amount of rotation required also goes to the user-friendliness of the blade removal tool (100), as well as its safety. With reference again to FIGS. 9-11, in one particular embodiment rotation of the blade engagement actuator (310) from the blade engagement actuator initial position (311) to the blade engagement actuator retaining position (312) produces a blade engagement actuator rotation range and results in rotation of the at least one blade engagement retainer (330) through a retainer rotation range from the retainer initial position (336) to the retainer retaining position (338), and the retainer rotation range is greater than the blade engagement actuator rotation range. In a further embodiment the retainer rotation range is at least 25% greater than the blade engagement actuator rotation range, while in a further embodiment it is at least 50% greater, and in even another embodiment it is at least 75% greater. In one particular embodiment the blade engagement actuator rotation range is 10-90 degrees and the blade engagement actuator rotation range is 30-135 degrees, while in another embodiment the blade engagement actuator rotation range is 15-75 degrees and the blade engagement actuator rotation range is 45-115 degrees, and in still a further embodiment the blade engagement actuator rotation range is 20-45 degrees and the blade engagement actuator rotation range is 60-100 degrees.

Conversely, in another embodiment the analogous ranges for the rotation of the blade unlocking actuator (410) and the blade unlocking post (430) should be more in unison. Thus, rotation of the blade unlocking actuator (410) from the blade unlocking actuator initial position (411) to the blade unlocking actuator release position (412) defines a blade unlocking actuator rotation range, and the associated rotation of the blade unlocking post (430) from the post initial position (431) to the post release position (432) defines a post rotation range. In one embodiment the post rotation range is less than 25% greater than the blade unlocking actuator rotation range. In another embodiment the post rotation range is less than 15% greater than the blade unlocking actuator rotation range, while in a further embodiment it is less than 10% greater, and in yet another embodiment post rotation range is no more than the blade unlocking actuator rotation range. The blade unlocking actuator rotation range and the post rotation range are both no more than 90 degrees in one particular embodiment, while in another embodiment they are both no more than 60 degrees, and in yet a further embodiment the are both 10-50 degrees, and both 15-30 degrees in still another embodiment.

Figure 18:
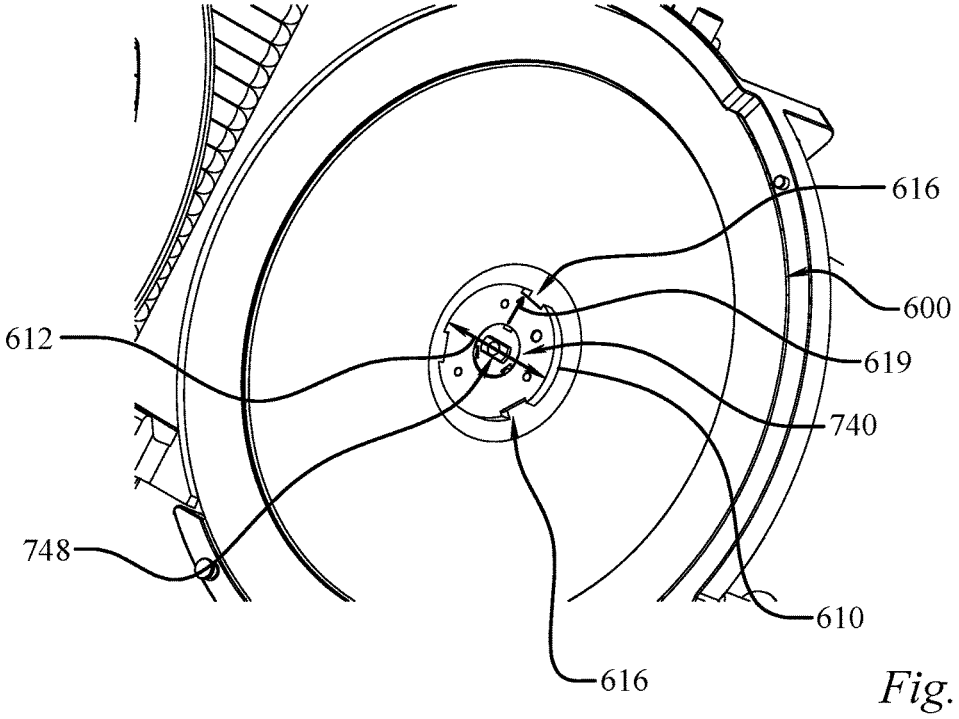
FIG. 18 shows an enlarged perspective view of an embodiment of a slicer, blade, hub, and a portion of the blade axle.
Figure 19:
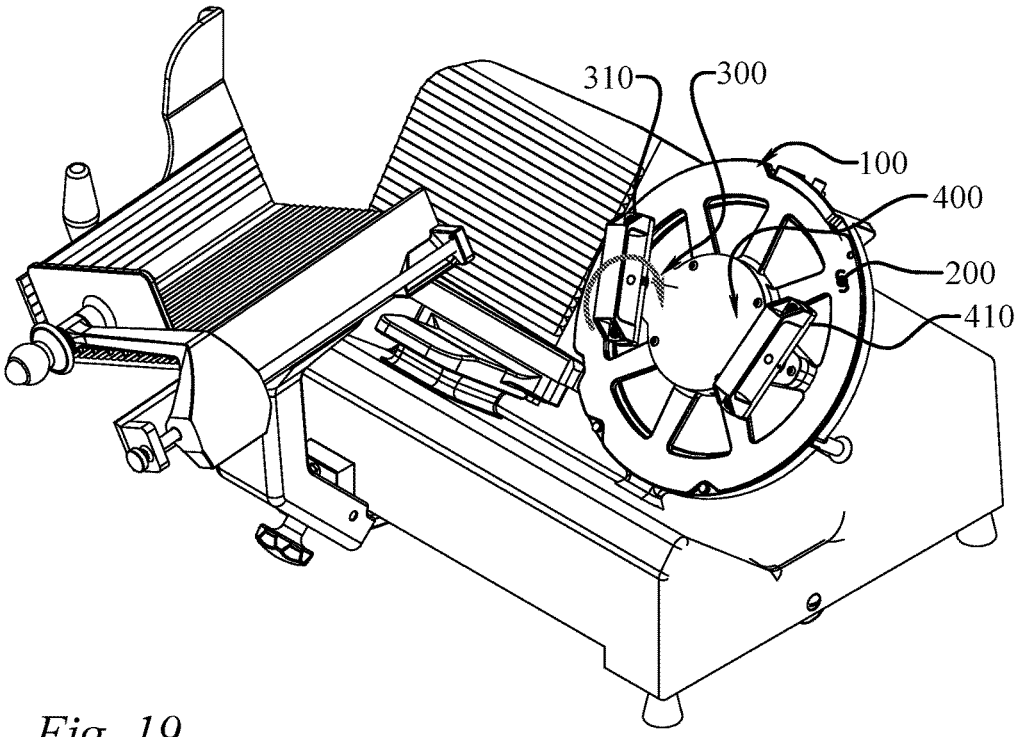
FIG. 19 shows a perspective view of an embodiment of a slicer with a blade removal tool brought into engagement to remove the blade, and illustrating the rotation of the blade engagement actuator from a blade engagement actuator initial position.
Figure 20:
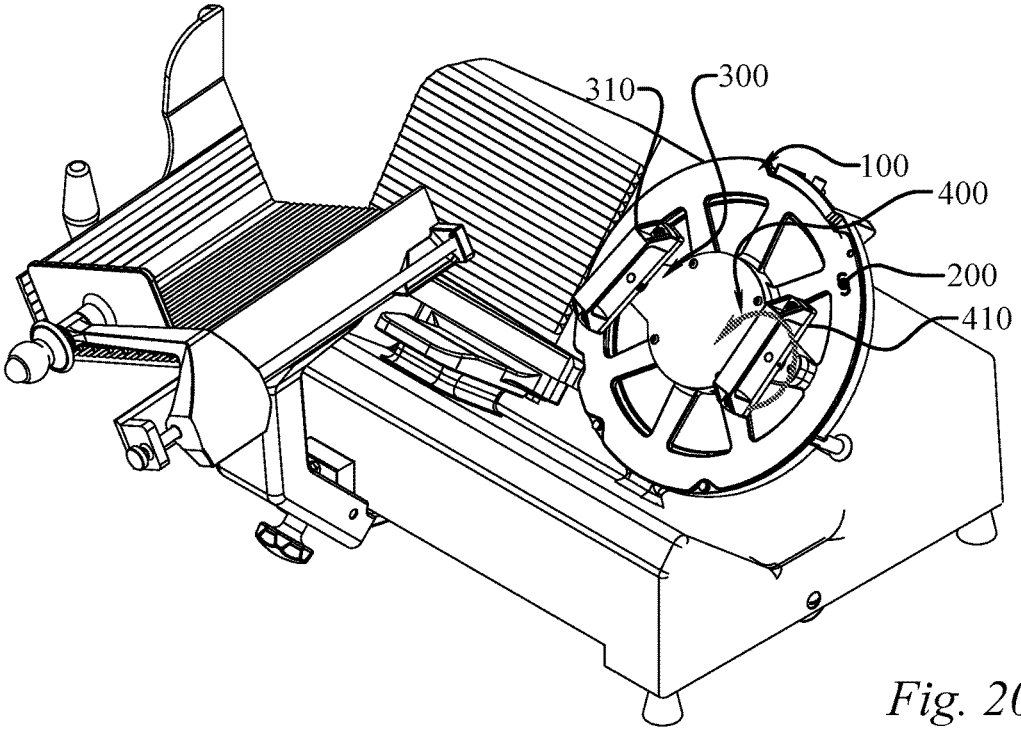
FIG. 20 shows a perspective view of an embodiment of a slicer with a blade removal tool brought into engagement, and illustrating the blade engagement actuator in a blade engagement actuator retaining position, as well as the rotation of the blade unlocking actuator from a blade unlocking actuator initial position.
Figure 21:
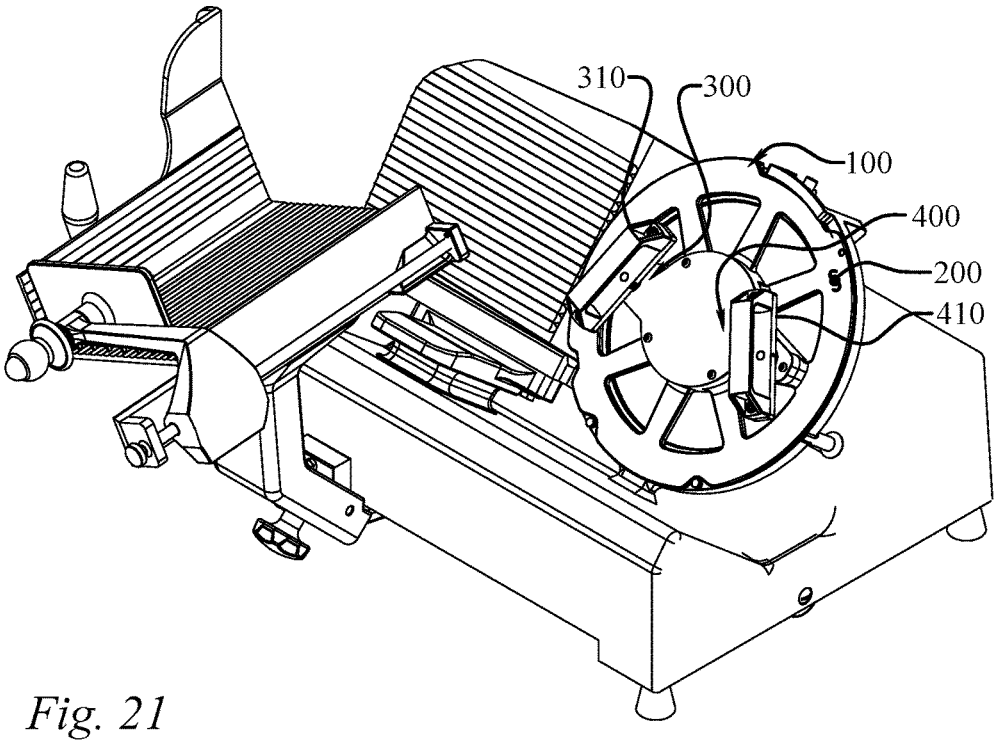
FIG. 21 shows a perspective view of an embodiment of a slicer with a blade removal tool brought into engagement, and illustrating the blade engagement actuator in the blade engagement actuator retaining position, as well as the rotation of the blade unlocking actuator in a blade unlocking actuator release position.
Figure 22:
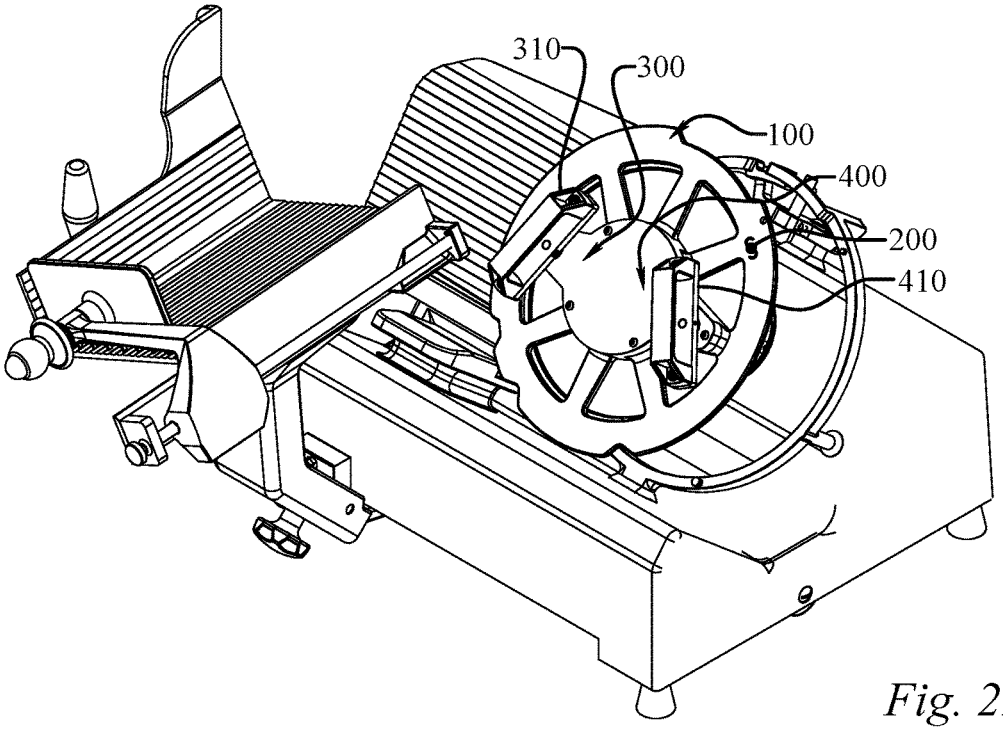
FIG. 22 shows a perspective view of an embodiment of a slicer with a blade removal tool safely removing the blade from the slicer.
Figure 23:
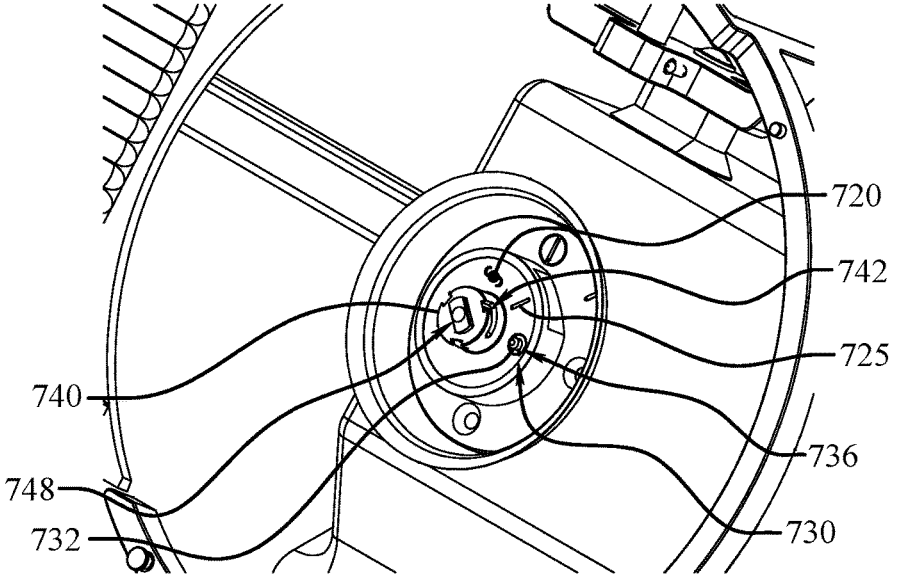
FIG. 23 shows a perspective view of an embodiment of a slicer and blade axle, with the blade removed.
Figure 24:
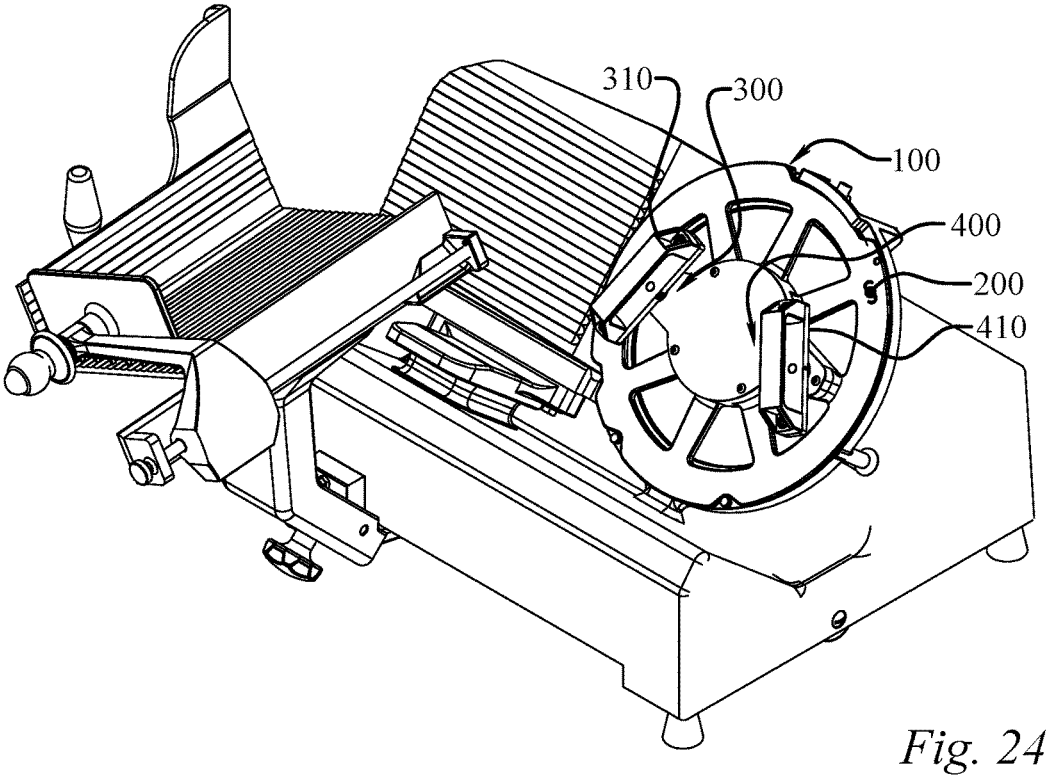
FIG. 24 shows a perspective view illustrating the start of the blade installation process showing an embodiment of a slicer with a blade removal tool and blade brought into engagement with the slicer and blade axle to install the blade, and illustrating the blade engagement actuator in the blade engagement actuator retaining position and the blade unlocking actuator in the blade unlocking actuator release position.
Figure 25:
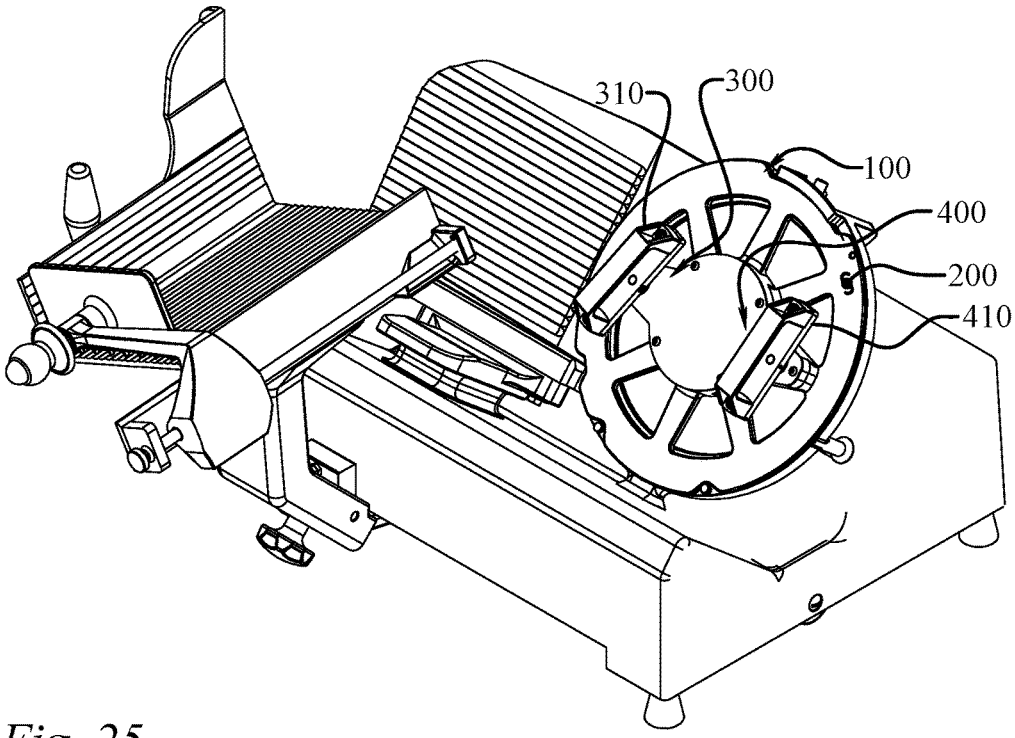
FIG. 25 shows a perspective view illustrating the blade installation process showing an embodiment of a slicer with a blade removal tool and blade brought into engagement with the slicer and blade axle to install the blade, and illustrating the blade unlocking actuator having been moved to the blade unlocking actuator initial position.
Figure 26:
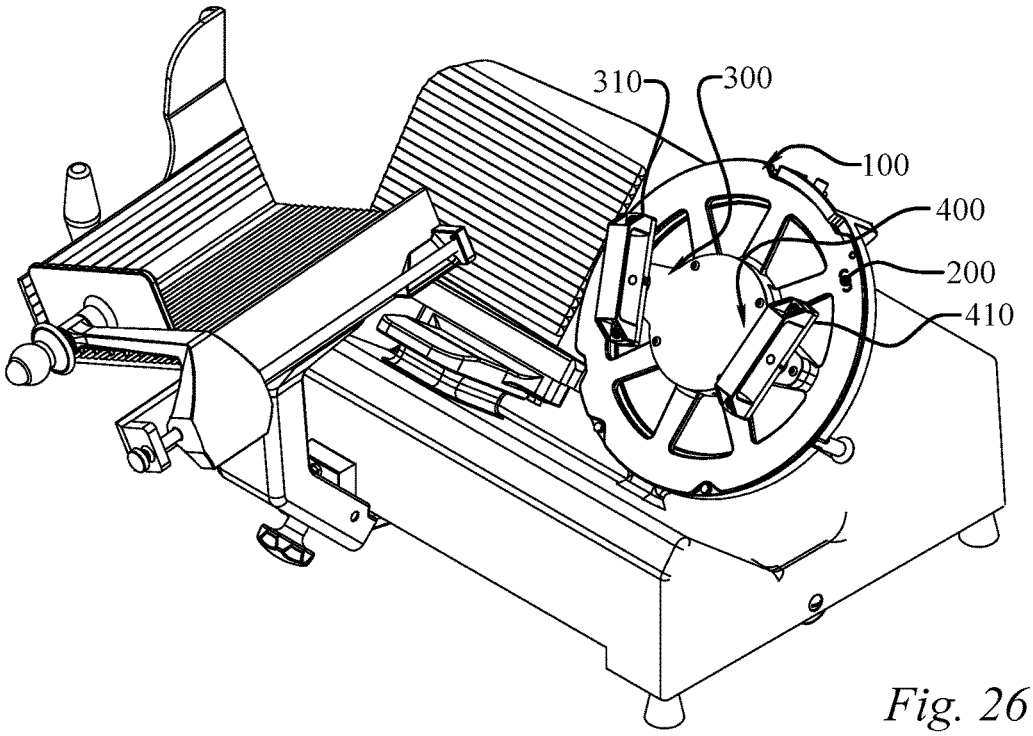
FIG. 26 shows a perspective view illustrating the blade installation process showing an embodiment of a slicer with a blade removal tool and blade brought into engagement with the slicer and blade axle to install the blade, and illustrating the blade engagement actuator having been moved to the blade engagement actuator initial position.
Figure 27:
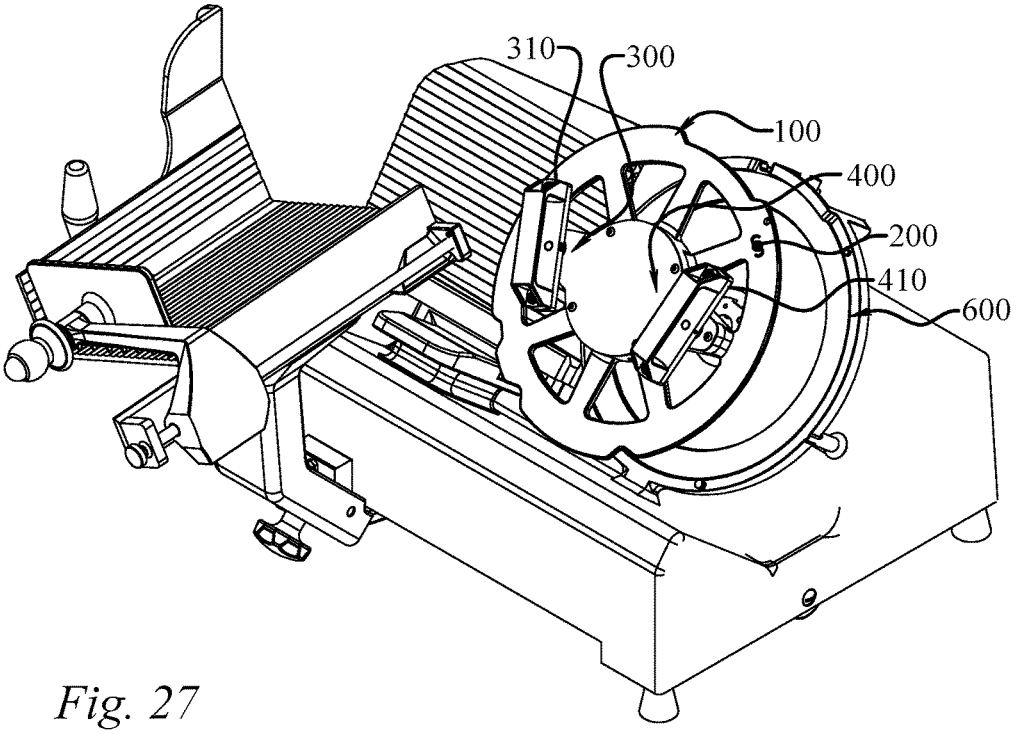
FIG. 27 shows a perspective view illustrating that the blade installation process is complete and the removal of the blade removal tool from the slicer.
Figure 28:
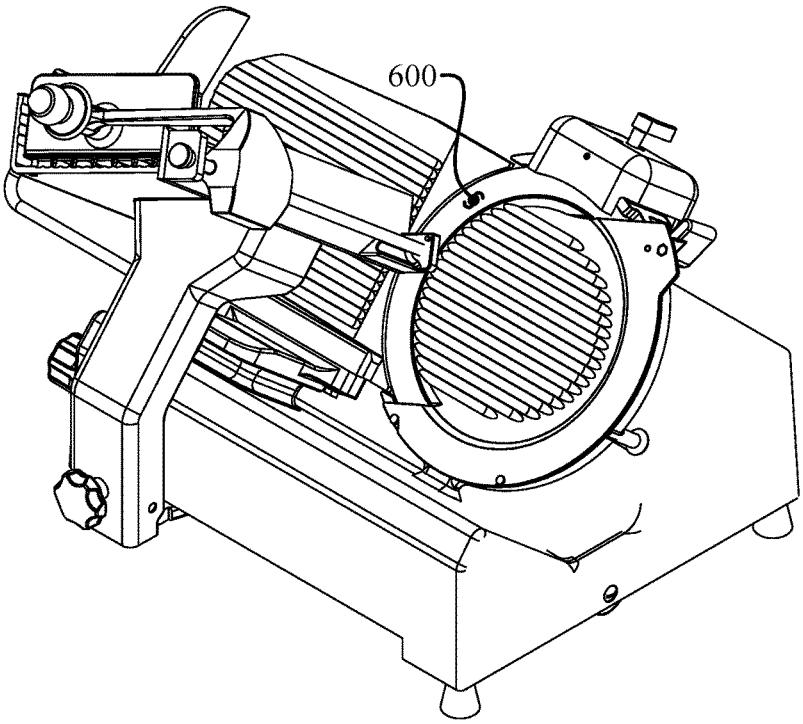
FIG. 28 shows a perspective view of an embodiment of the slicer with the blade guard and sharpener re-installed and heady for use.

As illustrated in FIGS. 12*b* and 18, the blade hub (610) may also include blade hub alignment indicia (619) that informs a user of a preferred orientation of the blade (600) for proper alignment with the blade removal tool (100), recognizing how the blade removal tool (100) is designed to be held. Similarly, the blade axle (700) may include blade axle alignment indicia (725), seen in FIG. 13, to assist in proper orientation. The indicia may be visual and/or tactile, and may include, but is not limited to, the illustrated arrow indicia configuration. In another embodiment the tool base (200) is formed with at least one blade viewing window (250), labeled in FIG. 2*a*, permitting the operator to see through the tool base (200) and visually confirm that the blade (600) is being remove while pulling on the blade removal tool (100), and also allows for weight reduction of the tool base (200). One embodiment includes a plurality of blade viewing windows (250) and the open area of the blade viewing windows (250) is at least 20% of the area bounded by the outer perimeter of the tool base (200).

Figure 2C:
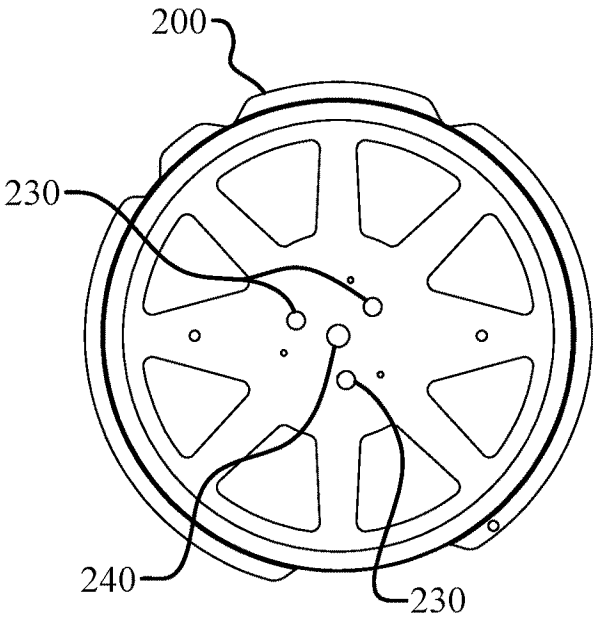
FIG. 2*c* shows a rear plan view of an embodiment of a tool base.
Figure 2B:
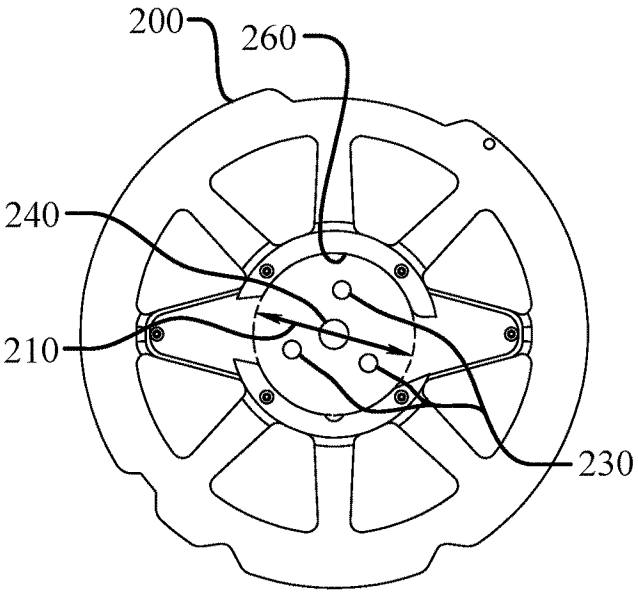
FIG. 2*b* shows a front plan view of an embodiment of a tool base.
Figure 4:
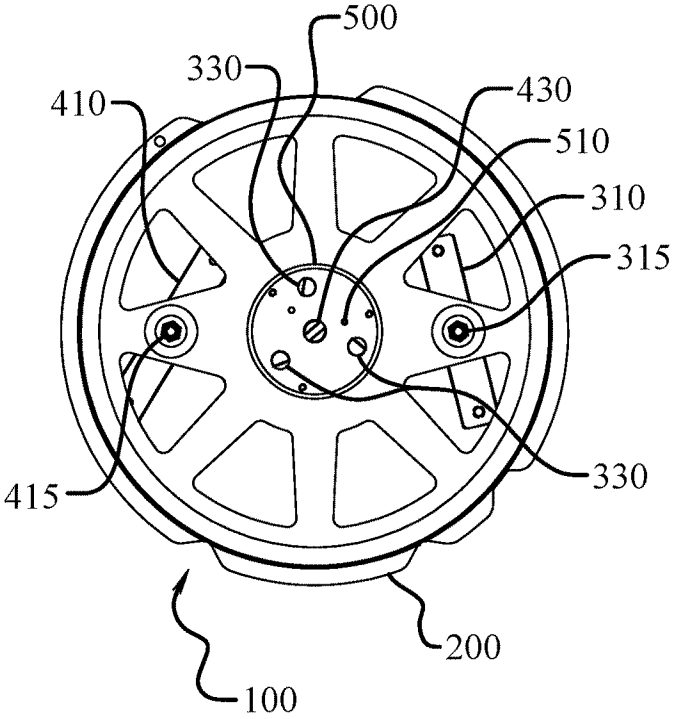
FIG. 4 shows a rear plan view of an embodiment of a blade removal tool.
Figure 3:
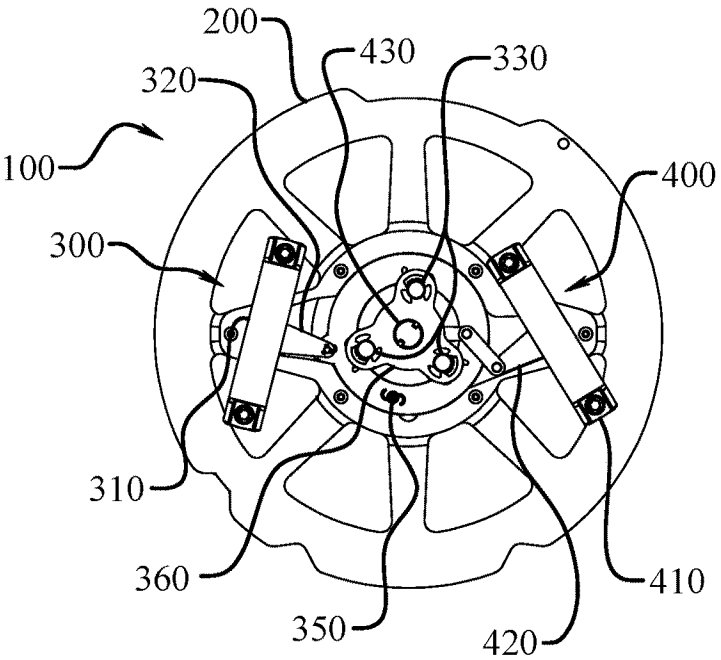
FIG. 3 shows a front plan view of an embodiment of a blade removal tool.

As seen in FIGS. 9 and 16, the blade (600) has a blade diameter (630) and the blade removal tool (100) has a tool outer diameter (220) that is greater than the blade diameter (630) throughout at least 25% of the perimeter of the blade removal tool (100), while this relationship is true throughout at least 50% of the perimeter of the blade removal tool (100) in another embodiment, at least 75% in still a further embodiment, and 100% in an even further embodiment. In a further embodiment, illustrated best in FIGS. 1 and 2*a*, the tool base (200) is formed with a base recess (260) to house the blade engagement actuator linkage (320), the blade unlocking linkage (420), at least a portion of the at least one blade engagement retainer (330), and at least a portion of the blade unlocking post (430). A recess closure (270) may enclose, and in at least one embodiment seal, the base recess (260) thereby preventing debris from entering the base recess (260) and interfering with the linkages (320, 420), as well as preventing lubricating agents from leaving the base recess (260). In one particular embodiment, seen in FIG. 2*b*, at least a portion of the base recess (260) has sidewalls bordering at least 50% of the perimeter of the drive plate (350), and defining a tool inner diameter (210), seen in FIG. 2*b*, that is within 5% of an outer diameter of the drive plate (350). In still a further embodiment a blade engagement cover plate (360), seen in FIG. 3, is one of the components within the base recess (260). The blade engagement cover plate (360) serves to constrain an end of the at least one blade engagement retainer (330), while allowing it to rotate. The blade engagement cover plate (360) may also include a central aperture to accommodate the axial motion of the blade unlocking post (430). Further, the tool base (200) be configured to include a blade engagement retainer aperture (230), as seen in FIGS. 2*b* and 2*c*, to allow a portion of the blade engagement retainer (330) to extend through a portion of the tool base (200), as well as a blade unlocking post aperture (240) to allow a portion of the blade unlocking post (430) to extend through a portion of the tool base (200).

In one embodiment the invention includes a product slicer having a motor in cooperation with any of the embodiments of the blade axle (700), blade (600), and/or blade removal tool (100) described herein thereby producing a safety enhanced product slicer, wherein the product slicer includes any, or all, of the features disclosed in U.S. patent application Ser. No. 15/042,172, all of which is incorporated herein by reference.

Additionally, yet another variation, not illustrated but easily understood in light of the extensive disclosure above, does not utilize a central blade unlocking post (430) that rotates to result in rotation of the blade axle (700) while the blade (600) is held stationary, but rather incorporates a stationary central anchor post to hold the blade axle (700) stationary while incorporating one or more blade unlocking posts (430), located radially outward from the stationary central post, which engage cooperating aspects on the blade (600), which may be recesses, indentations, or projections, so that the blade unlocking post (430) rotates the blade (600) relative to the stationary central anchor post to release the blade (600) from the blade mount (740). For instance, a blade unlocking drive plate based system similar to the drive plate (350) of the blade engagement assembly (300) described above, including any of its variations, may be incorporated to transmit movement of the blade unlocking actuator (410) to at least one blade unlocking post (430). Further, in this embodiment the at least one blade unlocking post (430) is similar to the blade engagement retainer (330) disclosed above, and seen in one embodiment in FIG. 12*a*, but the at least one blade unlocking post (430) may include a blade unlocking flange rather than a blade engagement retaining flange (332). In this embodiment the blade unlocking flange would contact and rotate the blade (600) rather than engage and retain the blade as is done by the blade engagement retaining flange (332). Thus, looking at FIG. 2*a*, one skilled in the art would appreciate how a blade unlocking drive plate could be located radially inward toward the center of the blade removal tool (100) from the drive plate (350) of the blade engagement assembly (300), or radially outward toward the perimeter of the blade removal tool (100) from the drive plate (350) of the blade engagement assembly (300). Similarly, just as the drive plate (350) of the blade engagement assembly (300) rotates at least one blade engagement retainer (330) so that the blade engagement retainer (332) locks the blade (600) to the blade removal tool (100), the blade unlocking drive plate would rotate at least one blade unlocking post (430) so that at least one blade unlocking flange contacts and imparts rotation to the blade (600) wile a stationary central anchor post holds the blade axle (700) and prevents it from rotating. Further, just as with the embodiments of the blade engagement assembly (300), these embodiments are not limited to the use of a blade unlocking drive plate to move the at least one blade unlocking post (400), which may be rotated or translated to cause rotation of the blade (600), but may incorporate other equivalents including, but not limited to, a linkage or cam system to produce the desired motion of the at least one blade unlocking post (400). In such embodiments the sequential movement of the blade engagement assembly (300) and the blade unlocking assembly (400), may be the reverse of that previously disclosed so that during blade removal the blade engagement retainer (330) does not engage the blade (600) until after the blade unlocking post (430) has rotated it about the stationary blade axle (700), and during installation the blade engagement retainer (330) releases its hold on the blade (600) before the blade unlocking post (430) rotates it about the stationary blade axle (700).

Figure 38:
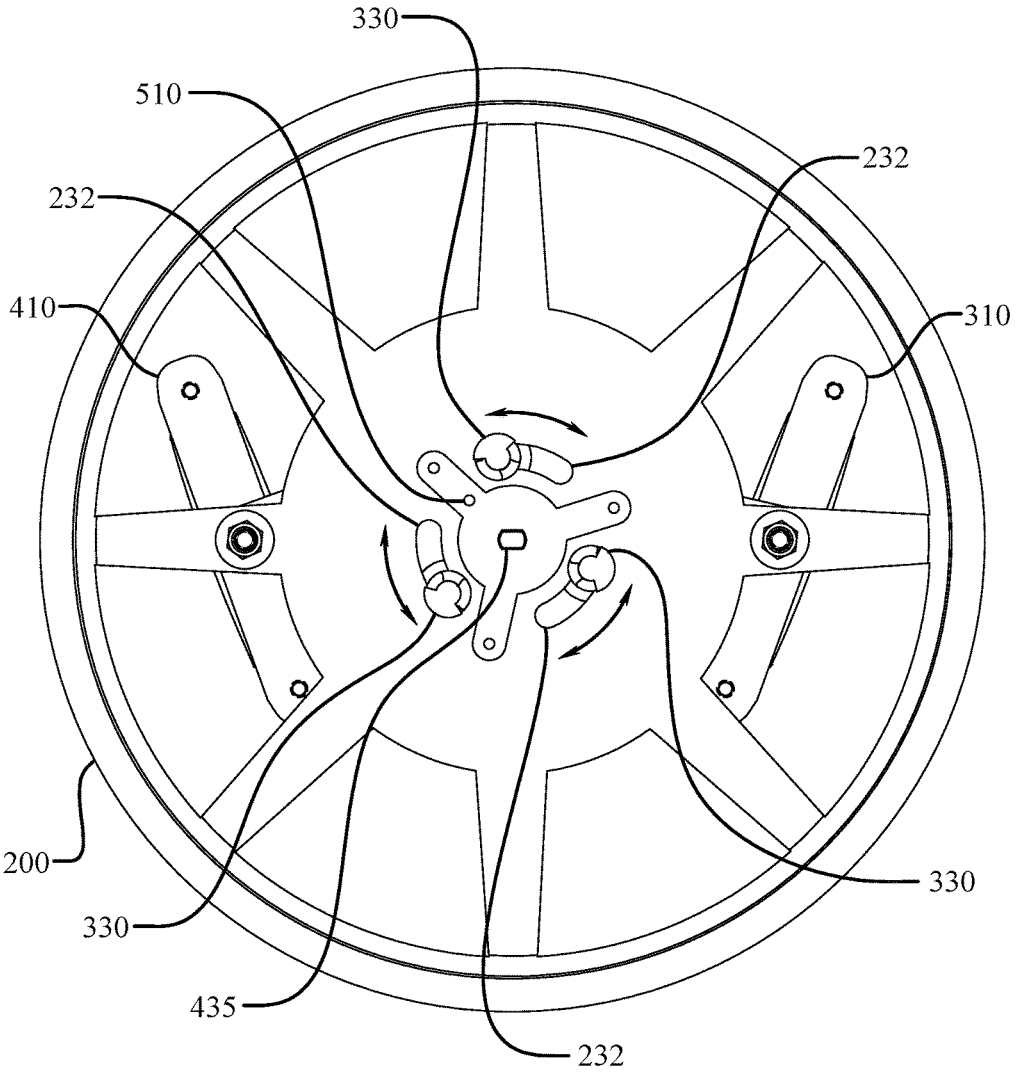
FIG. 38 shows a rear plan view of an embodiment of a blade removal tool.

In still another embodiment, seen in FIG. 38, actuation of the blade unlocking assembly (400) results in rotation of the at least one blade engagement retainer (330) about the center of the blade removal tool (100) or the center of the blade (600), which results in rotation of the blade (600). Thus, the tool base (200) includes a blade engagement retainer aperture (230) having a slot portion (232), in which the at least one blade engagement retainer (330) may move as it rotates about the center of the blade (600). In this embodiment actuation of the blade engagement assembly (300) results in the at least one blade engagement retainer (330) moving to engage the blade (600), which in this embodiment involves rotation about itself to grip a portion of the blade (600) or hub (610). Then, actuation of the blade unlocking assembly (400) results in the movement of the at least one blade engagement retainer (330), within the slot portion (232), as it rotates about the center of the blade (600), while the tool base (200) is held stationary, thereby resulting in relative rotation of the blade (600) and the blade axle (700) to facilitate removal of the blade (600). Further, yet another variation, not illustrated but easily understood in light of the extensive disclosure above, reverses the cooperative aspects of the blade (600) and the blade axle (700) such that the mount channel (742) aspects are incorporated into a projection from the blade (600), or hub (610), and the engagement protrusion (614) aspects of the blade (600) are incorporated into a portion of the blade axle (700).

Numerous alterations, modifications, and variations of the preferred embodiments disclosed herein will be apparent to those skilled in the art and they are all anticipated and contemplated to be within the spirit and scope of the instant invention. For example, although specific embodiments have been described in detail, those with skill in the art will understand that the preceding embodiments and variations can be modified to incorporate various types of substitute and or additional or alternative materials, relative arrangement of elements, and dimensional configurations. Accordingly, even though only few variations of the present invention are described herein, it is to be understood that the practice of such additional modifications and variations and the equivalents thereof, are within the spirit and scope of the invention as defined in the following claims. The corresponding structures, materials, acts, and equivalents of all means or step plus function elements in the claims below are intended to include any structure, material, or acts for performing the functions in combination with other claimed elements as specifically claimed.

We claim:

1. A safety blade mounting and removal system for a product slicer, comprising:

a blade (600) having a hub (610), a hub aperture (618), and at least one hub engagement protrusion (614) extending into the hub aperture (618);

a blade axle (700) having a multi-axis locking system for securing the blade (600) to the blade axle (700), wherein:

A) the multi-axis locking system includes a biased blade locking assembly (730) and a blade mount (740) having at least one mount channel (742) with an axial aspect (743) and a rotational aspect (745); and B) the at least one mount channel (742) cooperates with the at least one hub engagement protrusion (614) and alignment of the at least one hub engagement protrusion (614) with the at least one mount channel (742) permits the at least one hub engagement protrusion (614) to:

(i) translate axially in the at least one mount channel (742) an axial translation distance (744) at an axial translation position, and (ii) achieve relative rotational movement with respect to the blade mount (740) within the at least one mount channel (742), about a blade center, a rotational distance (746) allowing the biased blade locking assembly (730) to engage a receiver (620) in the blade (600) or the_hub (610), wherein the biased blade locking assembly (730) is located at an engagement angle (738) from the axial translation position, establishing a blade operating position, and thereby prevent movement of the at least one hub engagement protrusion (614) within the at least one mount channel (742) until the biased blade locking assembly (730) is disengaged from the receiver (620);

a blade removal tool (100) having:

A) a tool base (200);

B) a locking assembly release (510) attached to the tool base (200) and sized to cooperate with the receiver (620) and the biased blade locking assembly (730) to release the biased blade locking assembly (730) from the receiver (620) when the blade removal tool (100) engages the blade (600);

C) a blade engagement assembly (300) attached to the tool base (200) and having a blade engagement actuator (310) cooperating with at least one blade engagement retainer (330), wherein:

(i) relative movement of the blade engagement actuator (310) with respect to the tool base (200) from a blade engagement actuator initial position (311) to a blade engagement actuator retaining position (312) produces movement of the at least one blade engagement retainer (330) from a retainer initial position (336) to a retainer retaining position (338) whereby at least a portion of the blade engagement retainer (330) has engaged the hub (610) or blade (600) to interlock the tool base (200) and the blade (600);

D) a blade unlocking assembly (400) attached to the tool base (200) and having a blade unlocking actuator (410) cooperating with a blade unlocking post (430), wherein:

(i) relative movement of the blade unlocking actuator (410) with respect to the tool base (200) from a blade unlocking actuator initial position (411) to a blade unlocking actuator release position (412) produces rotation of the blade unlocking post (430) from a post initial position (431) to a post release position (432);

(ii) the blade unlocking post (430) cooperates with the blade mount (740) so that rotation of the blade unlocking post (430) produces rotation of the blade mount (740) with respect to the blade (600) and associated movement of the at least one hub engagement protrusion (614) within the at least one mount channel (742) from the blade operating position to re-align the at least one hub engagement protrusion (614) with the axial translation position and permit the blade (600) to be axially pulled, with the blade removal tool (100), from the blade mount (740); and (iii) the blade engagement assembly (300) and the blade unlocking assembly (400) cooperate so that relative movement of the blade unlocking actuator (410) cannot occur unless the blade engagement actuator (310) is in the blade engagement actuator retaining position (312), and relative movement of the blade engagement actuator (310) cannot occur when the blade unlocking actuator (410) is in the blade unlocking actuator release position (412), thereby requiring sequenced movement of both the blade engagement actuator (310) and the blade unlocking actuator (410) to secure the blade (600) to the removal tool (100) and remove the blade (600) from the slicer, and requiring sequenced movement of both the blade engagement actuator (310) and the blade unlocking actuator (410) to release the blade (600) from the removal tool (100).

2. The safety blade mounting and removal system of claim 1, wherein the blade unlocking actuator (410) is locked in place once in the blade unlocking actuator release position (412), and a release mechanism (475), separate from the blade engagement actuator (310) and the blade unlocking actuator (410), must be activated to release the blade unlocking actuator (410).

3. The safety blade mounting and removal system of claim 2, wherein the release mechanism requires (475) a force is applied to the blade removal tool (100) on a side opposite the blade engagement actuator (310) and the blade unlocking actuator (410) to be activated and release the blade unlocking actuator (410).

4. The safety blade mounting and removal system of claim 3, wherein the blade unlocking post (430) is biasedly mounted within the tool base (200) and is the release mechanism (475), whereby the blade unlocking post (430) must be depressed by contact with the blade mount (740), upon engagement of the blade removal tool (100) with the blade (600), to permit movement of the blade unlocking actuator (410).

5. The safety blade mounting and removal system of claim 1, wherein the blade unlocking post (430) has a blade unlocking post engager (435), and the blade mount (740) has a blade mount engager (748), wherein the blade unlocking post engager (435) and the blade mount engager (748) cooperate when the blade removal tool (100) engages the blade (600) to transmit rotation from the blade unlocking post (430) to the blade mount (740).

6. The safety blade mounting and removal system of claim 1, wherein the at least one hub engagement protrusion (614) is biasedly mounted within the hub (610) and during installation must be moved from an initial biased position to an installation position in order to achieve relative rotational movement with respect to the blade mount (740).

7. The safety blade mounting and removal system of claim 1, wherein the blade engagement actuator (310) and the blade unlocking actuator (410) are spaced apart from one another on the blade removal tool (100) a separation distance of at least 3 inches so that they cannot be operated simultaneously with a single hand.

8. The safety blade mounting and removal system of claim 7, wherein a first direction of motion of the blade engagement actuator (310) to the tool base (200) is not parallel to a second direction of motion of the blade unlocking actuator (410) to the tool base (200).

9. The safety blade mounting and removal system of claim 7, wherein the blade engagement actuator (310) is rotationally attached to the tool base (200), and the blade unlocking actuator (410) is rotationally attached to the tool base (200), and wherein a direction of rotation of the blade engagement actuator (310) that produces movement of the at least one blade engagement retainer (330) from the retainer initial position (336) to the retainer retaining position (338) is opposite a direction of rotation of the blade unlocking actuator (410) that produces rotation of the blade unlocking post (430) from the post initial position (431) to the post release position (432).

10. The safety blade mounting and removal system of claim 9, wherein rotation of the blade engagement actuator (310) from the blade engagement actuator initial position (311) to the blade engagement actuator retaining position (312) produces a blade engagement actuator rotation range and results in rotation of the at least one blade engagement retainer (330) through a retainer rotation range from the retainer initial position (336) to the retainer retaining position (338), and the retainer rotation range is greater than the blade engagement actuator rotation range.

11. The safety blade mounting and removal system of claim 10, wherein the retainer rotation range is at least 25% greater than the blade engagement actuator rotation range.

12. A safety blade mounting and removal system for removing a blade (600) from a blade axle (700) secured to a product slicer, comprising:

a blade removal tool (100) having:

A) a tool base (200);

B) a blade engagement assembly (300) attached to the tool base (200) and having a blade engagement actuator (310) cooperating with at least one blade engagement retainer (330), wherein relative movement of the blade engagement actuator (310) with respect to the tool base (200) from a blade engagement actuator initial position (311) to a blade engagement actuator retaining position (312) produces movement of the at least one blade engagement retainer (330) from a retainer initial position (336) to a retainer retaining position (338) whereby at least a portion of the blade engagement retainer (330) has engaged a portion of the blade (600) to interlock the tool base (200) and the blade (600); and C) a blade unlocking assembly (400) attached to the tool base (200) and having a blade unlocking actuator (410) cooperating with a blade unlocking post (430), wherein relative movement of the blade unlocking actuator (410) with respect to the tool base (200) from a blade unlocking actuator initial position (411) to a blade unlocking actuator release position (412) produces rotation of the blade unlocking post (430) from a post initial position (431) to a post release position (432), which rotates the blade axle (700) or the blade (600) to release the blade (600) from the blade axle (700), wherein the blade engagement assembly (300) and the blade unlocking assembly (400) cooperate so that relative movement of the blade unlocking actuator (410) cannot occur unless the blade engagement actuator (310) is in the blade engagement actuator retaining position (312), and relative movement of the blade engagement actuator (310) cannot occur when the blade unlocking actuator (410) is in the blade unlocking actuator release position (412), thereby requiring sequenced movement of both the blade engagement actuator (310) and the blade unlocking actuator (410) to secure the blade (600) to the removal tool (100) and remove the blade (600) from the slicer, and requiring sequenced movement of both the blade engagement actuator (310) and the blade unlocking actuator (410) to release the blade (600) from the removal tool (100).

13. The safety blade mounting and removal system of claim 12, wherein the blade unlocking actuator (410) is locked in place once in the blade unlocking actuator release position (412), and a release mechanism (475), separate from the blade engagement actuator (310) and the blade unlocking actuator (410), must be activated to release the blade unlocking actuator (410).

14. The safety blade mounting and removal system of claim 13, wherein the release mechanism requires (475) a force is applied to the blade removal tool (100) on a side opposite the blade engagement actuator (310) and the blade unlocking actuator (410) to be activated and release the blade unlocking actuator (410).

15. The safety blade mounting and removal system of claim 14, wherein the blade unlocking post (430) is biasedly mounted in the center of the tool base (200) and is the release mechanism (475), whereby the blade unlocking post (430) must be depressed by contact with a portion of the blade axle (700), upon engagement of the blade removal tool (100) with the blade (600), to permit movement of the blade unlocking actuator (410).

16. The safety blade mounting and removal system of claim 12, wherein the blade engagement actuator (310) and the blade unlocking actuator (410) are spaced apart from one another on the blade removal tool (100) a separation distance of at least 3 inches so that they cannot be operated simultaneously with a single hand.

17. The safety blade mounting and removal system of claim 16, wherein a first direction of motion of the blade engagement actuator (310) to the tool base (200) is not parallel to a second direction of motion of the blade unlocking actuator (410) to the tool base (200).

18. The safety blade mounting and removal system of claim 16, wherein the blade engagement actuator (310) is rotationally attached to the tool base (200), and the blade unlocking actuator (410) is rotationally attached to the tool base (200), and wherein a direction of rotation of the blade engagement actuator (310) that produces movement of the at least one blade engagement retainer (330) from the retainer initial position (336) to the retainer retaining position (338) is opposite a direction of rotation of the blade unlocking actuator (410) that produces rotation of the blade unlocking post (430) from the post initial position (431) to the post release position (432).

19. The safety blade mounting and removal system of claim 12, further including a locking assembly release (510) attached to the tool base (200) and sized to cooperate with a portion of the blade axle (700).

20. A safety blade mounting and removal system for removing a blade (600) from a blade axle (700) secured to a product slicer, comprising:

a blade removal tool (100) having:

A) a tool base (200);

B) a blade engagement assembly (300) attached to the tool base (200) and having a blade engagement actuator (310) cooperating with at least one blade engagement retainer (330), wherein relative movement of the blade engagement actuator (310) with respect to the tool base (200) from a blade engagement actuator initial position (311) to a blade engagement actuator retaining position (312) produces movement of the at least one blade engagement retainer (330) from a retainer initial position (336) to a retainer retaining position (338) whereby at least a portion of the blade engagement retainer (330) has engaged a portion of the blade (600) to interlock the tool base (200) and the blade (600); and C) a blade unlocking assembly (400) attached to the tool base (200) and having a blade unlocking actuator (410) cooperating with a blade unlocking post (430), wherein relative movement of the blade unlocking actuator (410) with respect to the tool base (200) from a blade unlocking actuator initial position (411) to a blade unlocking actuator release position (412) produces rotation of the blade unlocking post (430) from a post initial position (431) to a post release position (432), which rotates the blade axle (700) or the blade (600) to release the blade (600) from the blade axle (700), wherein the blade unlocking actuator (410) is locked in place once in the blade unlocking actuator release position (412), and a release mechanism (475), separate from the blade engagement actuator (310) and the blade unlocking actuator (410), must be activated to release the blade unlocking actuator (410), wherein the release mechanism requires (475) a force is applied to the blade removal tool (100) on a side opposite the blade engagement actuator (310) and the blade unlocking actuator (410) to be activated and release the blade unlocking actuator (410).

21. The safety blade mounting and removal system for removing a blade (600) from a blade axle (700) secured to a product slicer of claim 20, wherein the blade unlocking post (430) is biasedly mounted in the center of the tool base (200) and is the release mechanism (475), whereby the blade unlocking post (430) must be depressed by contact with a portion of the blade axle (700), upon engagement of the blade removal tool (100) with the blade (600), to permit movement of the blade unlocking actuator (410).

22. A safety blade mounting and removal system for removing a blade (600) from a blade axle (700) secured to a product slicer, comprising:

a blade removal tool (100) having:

A) a tool base (200);

B) a blade engagement assembly (300) attached to the tool base (200) and having a blade engagement actuator (310) cooperating with at least one blade engagement retainer (330), wherein relative movement of the blade engagement actuator (310) with respect to the tool base (200) from a blade engagement actuator initial position (311) to a blade engagement actuator retaining position (312) produces movement of the at least one blade engagement retainer (330) from a retainer initial position (336) to a retainer retaining position (338) whereby at least a portion of the blade engagement retainer (330) has engaged a portion of the blade (600) to interlock the tool base (200) and the blade (600); and C) a blade unlocking assembly (400) attached to the tool base (200) and having a blade unlocking actuator (410) cooperating with a blade unlocking post (430), wherein relative movement of the blade unlocking actuator (410) with respect to the tool base (200) from a blade unlocking actuator initial position (411) to a blade unlocking actuator release position (412) produces rotation of the blade unlocking post (430) from a post initial position (431) to a post release position (432), which rotates the blade axle (700) or the blade (600) to release the blade (600) from the blade axle (700), wherein the blade engagement actuator (310) and the blade unlocking actuator (410) are spaced apart from one another on the blade removal tool (100) a separation distance of at least 3 inches so that they cannot be operated simultaneously with a single hand.

23. The safety blade mounting and removal system of claim 22, wherein a first direction of motion of the blade engagement actuator (310) to the tool base (200) is not parallel to a second direction of motion of the blade unlocking actuator (410) to the tool base (200).

24. The safety blade mounting and removal system of claim 22, wherein the blade engagement actuator (310) is rotationally attached to the tool base (200), and the blade unlocking actuator (410) is rotationally attached to the tool base (200), and wherein a direction of rotation of the blade engagement actuator (310) that produces movement of the at least one blade engagement retainer (330) from the retainer initial position (336) to the retainer retaining position (338) is opposite a direction of rotation of the blade unlocking actuator (410) that produces rotation of the blade unlocking post (430) from the post initial position (431) to the post release position (432).

* * * * *